US010030444B2

(12) United States Patent
Colson et al.

(10) Patent No.: US 10,030,444 B2
(45) **Date of Patent: *Jul. 24, 2018**

(54) COVERING FOR ARCHITECTURAL OPENING INCLUDING CELL STRUCTURES BIASED TO OPEN

(71) Applicant: Hunter Douglas Inc., Pearl River, NY (US)

(72) Inventors: Wendell B. Colson, Weston, MA (US); Paul G. Swiszcz, Niwot, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,640

(22) Filed: Aug. 22, 2016

(65) Prior Publication Data

US 2016/0356080 A1 Dec. 8, 2016

Related U.S. Application Data

(63) Continuation of application No. 14/111,666, filed as application No. PCT/US2012/033670 on Apr. 13, 2012, now Pat. No. 9,540,874.

(Continued)

(51) Int. Cl.
*E06B 9/68* (2006.01)
*E06B 9/34* (2006.01)

(Continued)

(52) U.S. Cl.
CPC ..... *E06B 9/68* (2013.01); *A47H 23/04* (2013.01); *E06B 9/262* (2013.01); *E06B 9/264* (2013.01);

(Continued)

(58) Field of Classification Search
CPC ..... E06B 2009/2423; E06B 2009/2429; E06B 2009/2458; E06B 2009/2627; E06B 9/40; E06B 9/15

(Continued)

(56) References Cited

U.S. PATENT DOCUMENTS 496,204 A * 4/1893 Perry ..... B27B 25/04 144/242.1
1,962,868 A * 6/1934 Gregg ..... E04B 1/80 160/179

(Continued)

FOREIGN PATENT DOCUMENTS

CN 1918356 6/2005
CN 2703855 Y 6/2005

(Continued)

OTHER PUBLICATIONS

PCT International Search Report dated Jul. 17, 2012, PCT Application No. PCT/US2012/33670, 3 pages.

*Primary Examiner* — Katherine W Mitchell
*Assistant Examiner* — Johnnie A. Shablack

(57) ABSTRACT

A covering an architectural opening including a support tube and a panel operably connected to the support tube and configured to be wound around the support tube. The panel includes a support sheet and at least one cell operably connected to the support sheet. The at least one cell includes a vane material operably connected to a first side of the support sheet and a cell support member operably connected to the vane material and configured to support the vane material at a distance away from the support sheet when the panel is in an extended position with respect to the support tube.

22 Claims, 27 Drawing Sheets

Related U.S. Application Data

(60) Provisional application No. 61/476,187, filed on Apr. 15, 2011.

(51) Int. Cl.

| | |
|---|---|
| ***E06B 9/262*** | (2006.01) |
| ***E06B 9/386*** | (2006.01) |
| ***A47H 23/04*** | (2006.01) |
| ***E06B 9/40*** | (2006.01) |
| ***E06B 9/264*** | (2006.01) |
| ***E06B 9/36*** | (2006.01) |
| *E06B 9/24* | (2006.01) |
| *E06B 9/322* | (2006.01) |

(52) U.S. Cl.
CPC ..... *E06B 9/34* (2013.01); *E06B 9/36* (2013.01); *E06B 9/386* (2013.01); *E06B 9/40* (2013.01); *E06B 9/322* (2013.01); *E06B 2009/2429* (2013.01); *E06B 2009/2625* (2013.01); *E06B 2009/2627* (2013.01)

(58) Field of Classification Search
USPC ... 160/84.01, 84.04, 84.05, 108, 120, 121.1, 160/122
See application file for complete search history.

(56) References Cited

U.S. PATENT DOCUMENTS 2,012,887 A * 8/1935 Major ..... E06B 9/34 160/133
2,024,090 A * 12/1935 Cadmus ..... A47H 23/04 160/180
2,042,002 A * 5/1936 Hovey ..... B63B 19/21 160/133
2,200,605 A * 5/1940 Pierce ..... B21D 49/00 160/405
2,231,778 A * 2/1941 Swanson ..... E06B 9/308 160/168.1 R
2,267,867 A * 12/1941 Kienle ..... C09B 67/00 106/471
2,267,869 A * 12/1941 Loehr ..... E06B 9/34 160/133
2,620,869 A * 12/1952 Friedman ..... E06B 9/386 160/236
2,874,612 A * 2/1959 Luboshez ..... E04C 2/54 160/237
3,467,037 A * 9/1969 Frydryk ..... D05B 35/02 112/147
3,990,201 A 11/1976 Falbel
4,039,019 A 8/1977 Hopper
4,066,062 A 1/1978 Houston
4,078,323 A 3/1978 Baumgarten
4,157,108 A 6/1979 Donofrio
4,194,550 A 3/1980 Hopper
4,338,996 A 7/1982 Frank
4,359,079 A 11/1982 Bledsoe
4,382,436 A 5/1983 Hager
4,532,917 A 8/1985 Holdridge
4,535,828 A 8/1985 Brockhaus
4,550,758 A 11/1985 Johnson et al.
4,649,980 A 3/1987 Kunz
4,692,744 A 9/1987 Hickman
4,722,382 A 2/1988 Vecchiarelli
4,736,785 A 4/1988 Seuster
4,763,890 A 8/1988 Zimmerman
4,800,946 A 1/1989 Rosenoy
5,123,473 A * 6/1992 Henkenjohann ..... E06B 9/15 160/231.1
5,129,440 A 7/1992 Colson
5,217,000 A 6/1993 Pierce-Bjorklund
5,273,096 A 12/1993 Thomsen
5,325,579 A 7/1994 Baier
D352,856 S 11/1994 Ford
5,390,720 A * 2/1995 Colson ..... B31D 3/0215 160/84.07
5,391,967 A 2/1995 Domel et al.
5,419,385 A 5/1995 Vogel et al.
5,503,210 A 4/1996 Colson et al.
5,547,006 A 8/1996 Auger
5,566,738 A 10/1996 Yadidya
5,600,974 A 2/1997 Schnegg et al.
5,603,368 A 2/1997 Colson et al.
5,638,881 A * 6/1997 Ruggles ..... E06B 9/262 160/168.1 V
5,649,583 A * 7/1997 Hsu ..... E06B 9/262 160/84.05
5,787,951 A * 8/1998 Tonomura ..... E06B 9/262 160/84.01
5,797,442 A * 8/1998 Colson ..... B29C 53/40 160/236
5,845,690 A 12/1998 Colson et al.
5,876,545 A 3/1999 Swiszcz et al.
5,897,731 A 4/1999 Colson et al.
5,974,763 A * 11/1999 Colson ..... B31D 3/0207 160/84.05
6,006,812 A 12/1999 Corey
6,024,819 A 2/2000 Corey
6,052,966 A * 4/2000 Colson ..... B31D 3/0207 160/84.05
6,057,029 A 5/2000 Demestre et al.
6,076,588 A 6/2000 Swiszcz et al.
6,094,290 A 7/2000 Crawford et al.
6,103,336 A * 8/2000 Swiszcz ..... B31D 3/0207 160/84.01
D439,785 S 4/2001 Throne
D440,102 S 4/2001 Colson et al.
D444,658 S 7/2001 Swiszcz et al.
6,257,302 B1 7/2001 Bednarczyk et al.
D446,416 S 8/2001 Throne
6,302,982 B1 10/2001 Corey et al.
6,345,486 B1 * 2/2002 Colson ..... B31D 3/0207 160/84.05
6,354,353 B1 3/2002 Green et al.
6,374,896 B1 4/2002 Moller
D459,933 S 7/2002 Goodman
6,416,842 B1 * 7/2002 Swiszcz ..... B31D 3/0215 428/116
6,461,464 B1 * 10/2002 Swiszcz ..... B31D 3/0207 156/201
6,470,950 B2 10/2002 Shimizu
6,484,390 B1 11/2002 Gouldson et al.
6,550,519 B2 4/2003 Green et al.
6,613,404 B2 9/2003 Johnson
6,688,369 B2 2/2004 Colson et al.
6,745,811 B1 6/2004 Nien
6,758,211 B1 7/2004 Schmidt
D496,204 S 9/2004 Tuzmen
6,792,994 B2 9/2004 Lin
D498,105 S 11/2004 Tyner
D503,578 S 4/2005 Boehm
6,981,509 B2 * 1/2006 Sharapov ..... B60J 11/02 114/361
6,982,020 B2 * 1/2006 Swiszcz ..... B31D 3/0215 156/203
7,058,292 B2 6/2006 Hirano
7,063,122 B2 6/2006 Colson et al.
7,100,666 B2 9/2006 Colson et al.
7,111,659 B2 9/2006 Harper et al.
7,191,816 B2 3/2007 Colson et al.
7,409,980 B1 8/2008 Heissenberg
7,418,313 B2 8/2008 Devis et al.
7,513,292 B2 4/2009 Auger et al.
7,549,455 B2 6/2009 Harper et al.
7,588,068 B2 9/2009 Colson et al.
7,637,301 B2 12/2009 Forst
7,708,047 B2 5/2010 Auger
D632,493 S 2/2011 Colson et al.
D636,204 S 4/2011 Elinson et al.
D640,472 S 6/2011 Colson et al.
7,971,624 B2 7/2011 Harper et al.

(56) References Cited

U.S. PATENT DOCUMENTS

| | | | | |
|---|---|---|---|---|
| 8,020,602 | B2 | 9/2011 | Smith et al. | |
| D646,516 | S | 10/2011 | Ehrsam | |
| D657,176 | S | 4/2012 | Stern | |
| 8,171,640 | B2 | 5/2012 | Colson et al. | |
| 8,261,807 | B2 | 9/2012 | Dann et al. | |
| D668,090 | S | 10/2012 | Colson et al. | |
| D671,349 | S | 11/2012 | Judkins | |
| 8,393,080 | B2 | 3/2013 | Ballard, Jr. et al. | |
| D685,210 | S * | 7/2013 | Josephson | D6/575 |
| D686,433 | S | 7/2013 | Marocco | |
| 8,496,768 | B2 | 7/2013 | Holt et al. | |
| D691,397 | S | 10/2013 | Colson et al. | |
| D692,684 | S | 11/2013 | Colson et al. | |
| D693,600 | S | 11/2013 | Jelic et al. | |
| 8,639,387 | B2 | 1/2014 | Byberg et al. | |
| 8,763,673 | B2 | 7/2014 | Jelic et al. | |
| D734,061 | S * | 7/2015 | Colson | D6/580 |
| 9,249,618 | B2 * | 2/2016 | Sevcik | E06B 9/30 |
| 9,376,860 | B2 * | 6/2016 | Josephson | E06B 9/30 |
| 9,382,754 | B2 * | 7/2016 | Malkan | E06B 9/262 |
| D764,836 | S * | 8/2016 | Rupel | D6/575 |
| 9,540,874 | B2 | 1/2017 | Colson et al. | |
| 2001/0037849 | A1 | 11/2001 | Corey et al. | |
| 2002/0088559 | A1 | 1/2002 | Green et al. | |
| 2004/0065416 | A1 | 4/2004 | Auger et al. | |
| 2004/0163773 | A1 | 8/2004 | Murray | |
| 2006/0179991 | A1 | 8/2006 | Nien et al. | |
| 2006/0191646 | A1 * | 8/2006 | Harper | E06B 9/264 160/84.05 |
| 2006/0207730 | A1 | 9/2006 | Berman et al. | |
| 2007/0074826 | A1 | 4/2007 | Jelic et al. | |
| 2007/0088104 | A1 | 4/2007 | Hung | |
| 2008/0014446 | A1 | 1/2008 | Donea et al. | |
| 2008/0066277 | A1 | 3/2008 | Colson et al. | |
| 2008/0127598 | A1 | 6/2008 | Kallstrom | |
| 2008/0264572 | A1 * | 10/2008 | Forst Randle | E06B 9/40 160/84.05 |
| 2008/0303686 | A1 | 12/2008 | Mosbrucker | |
| 2009/0205789 | A1 | 8/2009 | Watkins et al. | |
| 2009/0321024 | A1 * | 12/2009 | Harper | E06B 9/264 160/293.1 |
| 2010/0126675 | A1 | 5/2010 | Jelic et al. | |
| 2010/0186903 | A1 | 7/2010 | Liang et al. | |
| 2010/0266801 | A1 | 10/2010 | Jahoda et al. | |
| 2010/0276088 | A1 | 11/2010 | Jelic et al. | |
| 2010/0276089 | A1 | 11/2010 | Jelic et al. | |
| 2010/0288446 | A1 * | 11/2010 | Foley | E06B 9/262 160/84.04 |
| 2011/0088324 | A1 | 4/2011 | Wessel | |
| 2011/0088852 | A1 | 4/2011 | Hu et al. | |
| 2011/0094689 | A1 | 4/2011 | Dwarka | |
| 2011/0133940 | A1 | 6/2011 | Margalit | |
| 2011/0146922 | A1 | 6/2011 | Colson et al. | |
| 2011/0170170 | A1 | 7/2011 | Boote | |
| 2011/0220303 | A1 * | 9/2011 | Colson | E06B 9/34 160/133 |
| 2012/0038841 | A1 * | 2/2012 | Taheri | H01L 31/055 349/25 |
| 2012/0118514 | A1 * | 5/2012 | Hughes | E06B 9/08 160/25 |
| 2012/0222722 | A1 | 9/2012 | Baruchi et al. | |
| 2012/0241104 | A1 | 9/2012 | Huffer et al. | |
| 2012/0318475 | A1 | 12/2012 | Glover | |
| 2013/0038093 | A1 | 2/2013 | Snider | |
| 2013/0098565 | A1 | 4/2013 | Colson et al. | |
| 2013/0105094 | A1 | 5/2013 | Colson et al. | |
| 2013/0128336 | A1 | 5/2013 | Dean et al. | |
| 2013/0180676 | A1 | 7/2013 | Berman et al. | |
| 2013/0228290 | A1 * | 9/2013 | Rupel | E06B 9/262 160/84.05 |
| 2013/0240158 | A1 | 9/2013 | Chen | |
| 2014/0034251 | A1 | 2/2014 | Colson | |
| 2014/0053989 | A1 * | 2/2014 | Colson | E06L 39/34 160/84.04 |
| 2014/0168779 | A1 * | 6/2014 | Malkan | E06B 9/262 359/614 |
| 2014/0284004 | A1 * | 9/2014 | Sevcik | E06L 39/30 160/84.04 |
| 2015/0041072 | A1 | 2/2015 | Hsu et al. | |
| 2015/0184450 | A1 * | 7/2015 | Rupel | E06B 9/262 160/84.05 |
| 2015/0322714 | A1 * | 11/2015 | Rupel | E06B 9/262 160/84.05 |
| 2016/0145938 | A1 | 5/2016 | Colson et al. | |

FOREIGN PATENT DOCUMENTS

| | | | |
|---|---|---|---|
| CN | 1246564 | C | 3/2006 |
| CN | 201194726 | Y | 2/2009 |
| CN | 101984889 | A | 3/2011 |
| DE | 70451 | | 8/1893 |
| DE | 2709207 | A1 | 9/1978 |
| DE | 3912528 | A1 | 10/1990 |
| EP | 0511956 | A1 | 3/1991 |
| EP | 0818601 | A1 | 1/1998 |
| EP | 1347148 | A2 | 9/2003 |
| EP | 2113626 | A2 | 11/2009 |
| GB | 1494842 | A | 12/1977 |
| JP | 08511591 | A | 12/1996 |
| JP | 3832007 | B2 | 10/2006 |
| JP | 2007515577 | A | 6/2007 |
| TW | 310303 | B | 7/1997 |
| WO | 97/04207 | A1 | 2/1997 |
| WO | 02/06619 | A1 | 1/2002 |
| WO | 02/41740 | A1 | 5/2002 |
| WO | 03/008751 | A1 | 1/2003 |
| WO | 2005/062875 | A2 | 7/2005 |
| WO | 2005/098190 | A1 | 10/2005 |
| WO | 2009/103045 | A2 | 8/2009 |
| WO | 2010/059581 | A3 | 5/2010 |
| WO | 2011/130593 | A2 | 10/2011 |
| WO | 2012/142519 | A1 | 10/2012 |
| WO | 2012/142522 | A1 | 10/2012 |

* cited by examiner

Fig. 28
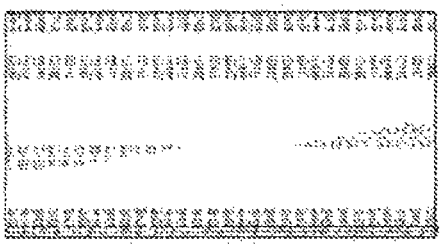
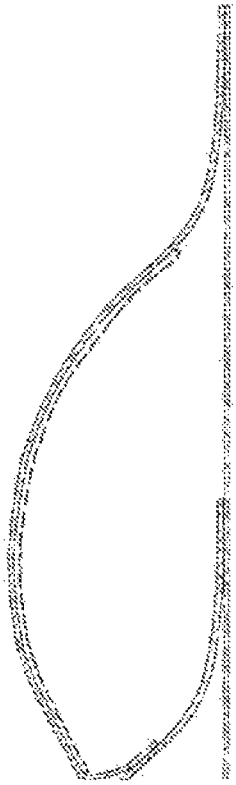
Fig. 29
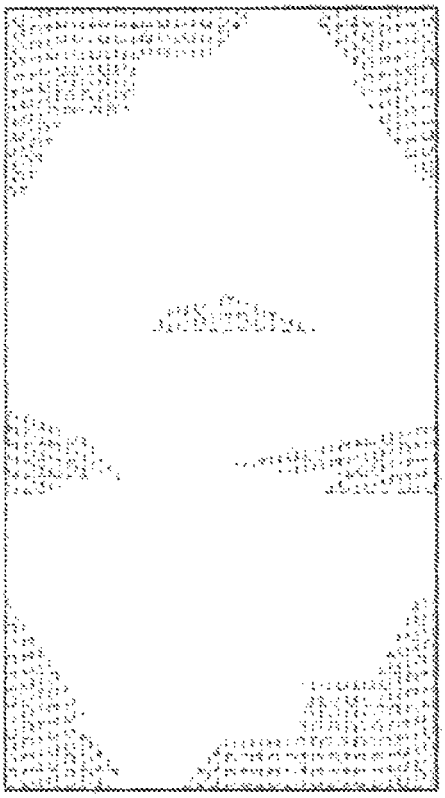
Fig. 30
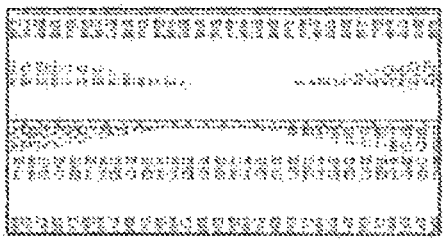
Fig. 31

Fig. 34
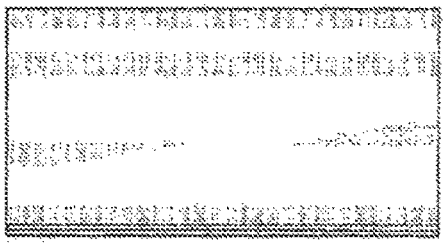
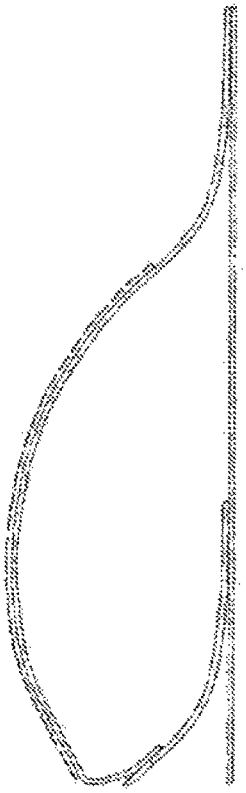
Fig. 35
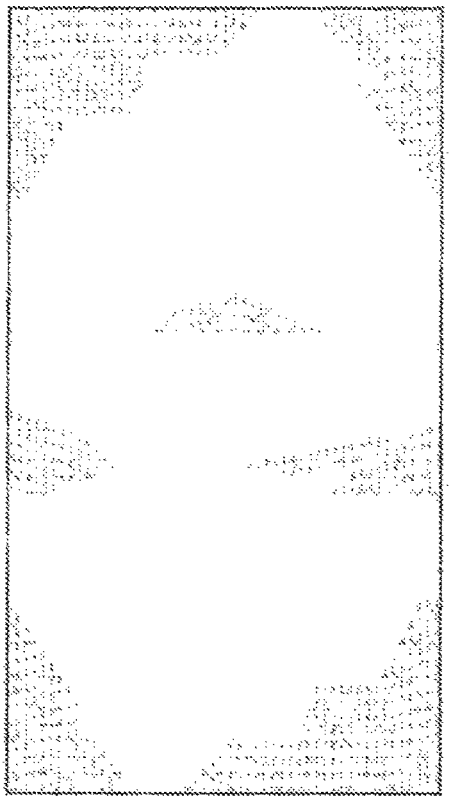
Fig. 36
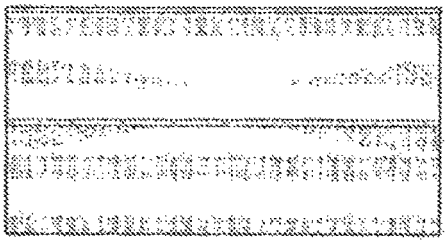
Fig. 37

COVERING FOR ARCHITECTURAL OPENING INCLUDING CELL STRUCTURES BIASED TO OPEN

CROSS-REFERENCE TO RELATED APPLICATIONS

The present application is a continuation of co-pending U.S. patent application Ser. No. 14/111,666, filed Oct. 14, 2013, entitled "Covering For Architectural Opening Including Cell Structures Biased to Open", which is the Section 371 of PCT International Patent Application No. PCT/US2012/033670, filed Apr. 13, 2012, entitled "Covering For Architectural Opening Including Cell Structures Biased to Open", which claims the benefit under 35 U.S.C. § 119(e) to U.S. provisional patent application No. 61/476,187, filed Apr. 15, 2011, entitled "Shade with Bias to Open Cells," which are all hereby incorporated by reference into the present application in their entireties. This application is related to co-pending U.S. patent application Ser. No. 14/111,680, filed Oct. 14, 2013, entitled "Covering For Architectural Opening Including Thermoformable Slat Vanes," which is the Section 371 of PCT International patent application No. PCT/US2012/033674, filed Apr. 13, 2012, entitled "Covering for Architectural Opening Including Thermoformable Slat Vanes," which claims the benefit under 35 U.S.C. § 119(e) to U.S. provisional patent application No. 61/476,187, filed Apr. 15, 2011, entitled "Shade with Bias to Open Cells," which are all hereby incorporated by reference into the present application in their entireties.

FIELD

The present disclosure relates generally to coverings for architectural openings, and more specifically, to retractable cellular coverings for architectural openings.

BACKGROUND

Coverings for architectural openings such as windows, doors, archways, and the like have assumed numerous forms for many years. Early forms of such coverings consisted primarily of fabric draped across the architectural opening, and in some instances the fabric was not movable between extended and retracted positions relative to the opening. Some newer versions of coverings may include cellular shades. Cellular shades may include horizontally disposed collapsible tubes that are vertically stacked to form a panel of tubes. The cellular tubes may trap air, and so if used to cover windows may help provide an insulative factor. In these shades the panel is retracted and extended by lifting or lowering the lowermost cell. As the lowermost cell is lifted, it lifts the cells above it and collapses them atop one another. As the lowermost cell is lowered, the cells are pulled open. When in a retracted position, current cellular shades are stored in a stacked configuration, i.e., one cell on top of the other cells. This retracted configuration is required, since wrapping the cells around a roller tube may damage the cells and/or prevent cells from opening.

SUMMARY

The present disclosure includes a covering for an architectural opening. The covering for an architectural opening includes a support tube and a panel operably connected to the support tube. The support tube may be configured to support the panel from above or the side of the architectural opening. The panel is configured to be wound around the support tube. The rotation of the support tube is controlled by activation cords engaging a drive mechanism, which in turn engages the support tube. The panel includes a support sheet and at least one cell operably connected to the support sheet. The cell includes a first material operably connected to a first side of the support sheet and a cell support member operably connected to the first material and configured to support the first material at a distance away from the support sheet when the panel is an extended position with respect to the support tube.

In some examples, the covering may include a first cell and a second cell. The first cell includes a first cellular support member and a first vane material operably connected to the first cellular support member. The first vane material includes a first top portion, a first middle portion, and a first bottom portion. The first top portion is operably connected to the support sheet adjacent a first top edge of the first vane material defining a first leg, the first top portion extends downwards adjacent the support sheet and at a first inflection point transitions away from the support sheet to the first middle portion, the first middle portion transitions at a second inflection point to the first bottom portion, and the first bottom portion is folded rearwardly to face the support sheet. The second cell includes a second cellular support member and a second vane material operably connected to the cellular support member. The second vane material includes a second top portion, a second middle portion, and a second bottom portion. The second top portion is operably connected to the support sheet adjacent a second top edge of the second vane material defining a second leg, the second top portion extends downwards adjacent the support sheet and at a third inflection point transitions away from the support sheet to the second middle portion, the second middle portion transitions at a fourth inflection point to the second bottom portion, and the second bottom portion is folded rearwardly to face the support sheet.

Other examples of the present disclosure may take the form of a method for manufacturing a covering for an architectural opening. The method includes operably connecting a vane material and a cell support member, wrapping the vane material and the cell support member around a support tube, heating the vane material and the cell support member so that the cell support member forms a shape substantially the same as a shape of or corresponding to the support tube, cooling the vane material, the cell support member and the support tube.

The cellular shade panel of the present disclosure substantially maintains its appearance during retraction or extension from the support tube, creating and maintaining a constant clean appearance without gathering or distortion of the cell shapes. The cellular shade panel may be manually retracted or extended using control cords, or may be extended or retracted by a motor drive system without the use of control cords.

Yet other examples of the present disclosure may take the form of a shade for an architectural opening. The shade includes a support sheet, a first cell operably connected to the support sheet, and a second cell operably connected to the support sheet. The first cell includes a first vane material operably connected at a first location to the support sheet and a first cell support member operably connected to the first vane material and configured to define a first cell chamber between the support sheet and the first vane material when the shade is in an extended position. The second cell includes a second vane material operably connected at a second location to the support sheet and operably connected at a third location to the first vane material and a second cell support member operably connected to the second vane material and configured to define a second cell chamber between the support sheet and the second vane material when the shade is in an extended position.

These and other aspects of embodiments of the disclosure will become apparent from the detailed description and drawings that follow.

BRIEF DESCRIPTION OF THE DRAWINGS

FIG. 28 is a top plan view of the cell of FIG. 26.

FIG. 29 is a side elevation view of the cell of FIG. 26.

FIG. 30 is a rear elevation view of the cell of FIG. 26.

FIG. 31 is a bottom plan view of the cell of FIG. 26.

FIG. 34 is a top plan view of the cell of FIG. 32.

FIG. 35 is a side elevation view of the cell of FIG. 32.

FIG. 36 is a rear elevation view of the cell of FIG. 32.

FIG. 37 is a bottom plan view of the cell of FIG. 32.

SPECIFICATION

General Description

Figure 1:
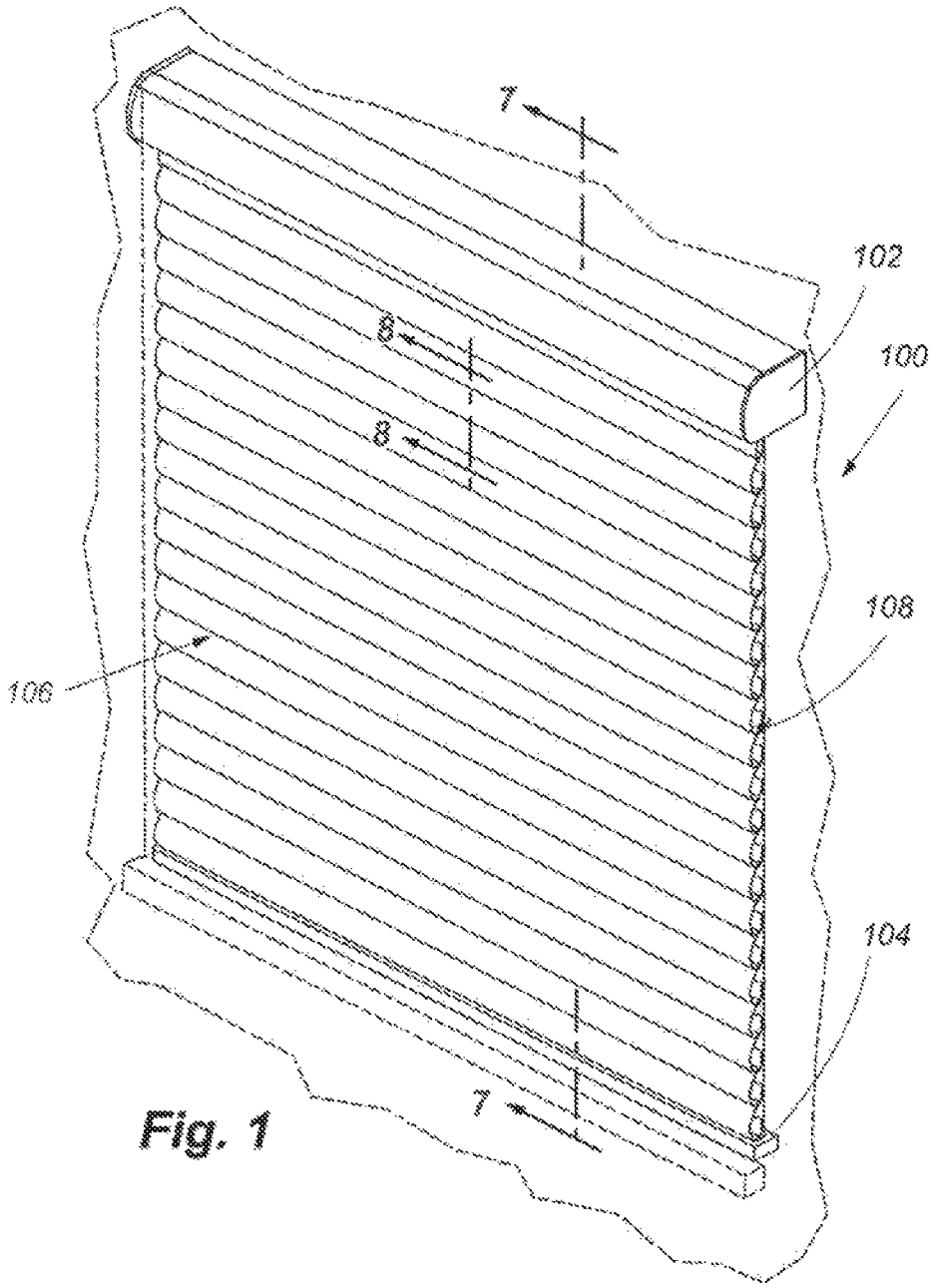
FIG. 1 is an isometric view of one embodiment of a panel for covering an architectural opening.

The present disclosure relates generally to a cellular panel for covering an architectural opening. The cellular panel or covering may be configured so that it may be retracted and expanded, and when in the retracted position the cellular panel may be wound around a support tube, bar, rod, or the like. Additionally, the cellular panel may be configured so that each cell within the panel may be biased to open configurations as the cellular panel is extended. This allows the cellular panel to provide the benefits of a cellular covering (e.g., insulation, aesthetic appeal), while at the same time providing the benefits of a non-cell shaped covering (e.g., hidden and compact storage). Specifically, by having a retracted position that allows the cellular panel to be stored around a support tube, the cellular shade may be stored from view behind a head rail. This is beneficial as prior art cellular shades may be stored only in a vertically stacked position and thus would not be fully hidden from view in a head rail. Additionally, because the cellular panel may be rolled onto a support tube, it may be protected by a head rail or other member from dust, sun damage (e.g., fading), and so on. Furthermore, in some embodiments, the cellular panel may be retracted to a stacked position, alternatively to being wound around a support tube, thus the cellular panel as described herein may have the option to be both stacked or rolled when in the retracted position.

Some embodiments of the cellular panel may include cells that extend laterally and are positioned vertically relative to one another. Each cell may be operably associated with adjacent upper and lower cells and operably connected to a support sheet. The cells may be formed by a combination of the support sheet, the adjacent lower cell, and the vane material of the respective cell. In some embodiments, each cell may be operably connected to the support sheet such that a top free portion or leg may extend past a point of connection between the cell and the support sheet. This leg may assist the cell in biasing open as the cellular panel is extended. Each cell may be generally tear-drop shaped in cross section, and form a tube extending length-wise across the cellular panel, and the ends of each cell may be open. Each of the cells includes a cell support member that may be heat formed to the particular shape of the support roll. For example, the cell support member may be a thermoformable or thermoset material that becomes partially or substantially shapeable after heating, and retains its formed shape after cooling. The cell support member may be operably connected to the vane material (e.g., fabric) and form an outer covering of the vane, or an inner covering of the vane. However, in some embodiments, the cell support member may be integrated with material forming each cell.

The cellular panel is formed by operably connecting the cell support member to a vane material and then wrapping both the vane material and the cell support member around a support tube, mandrel, or other forming member. The support tube, the vane material, and the cell support member may then heated. As the components are heated, the cell support member is re-shaped to conform generally to the shape of the support tube. After cooling, the vane material takes on the shape of the cell support member where the two are engaged. Then, the support tube and cellular panel may be installed over an architectural opening.

It should be noted that embodiments herein may refer to a panel or shade for covering an architectural opening. However, the panels disclosed herein may be used in various manners. For example, the panels may be used as wall coverings, wallpaper, ceilings, and so on.

Cellular Panel

Figure 2A:
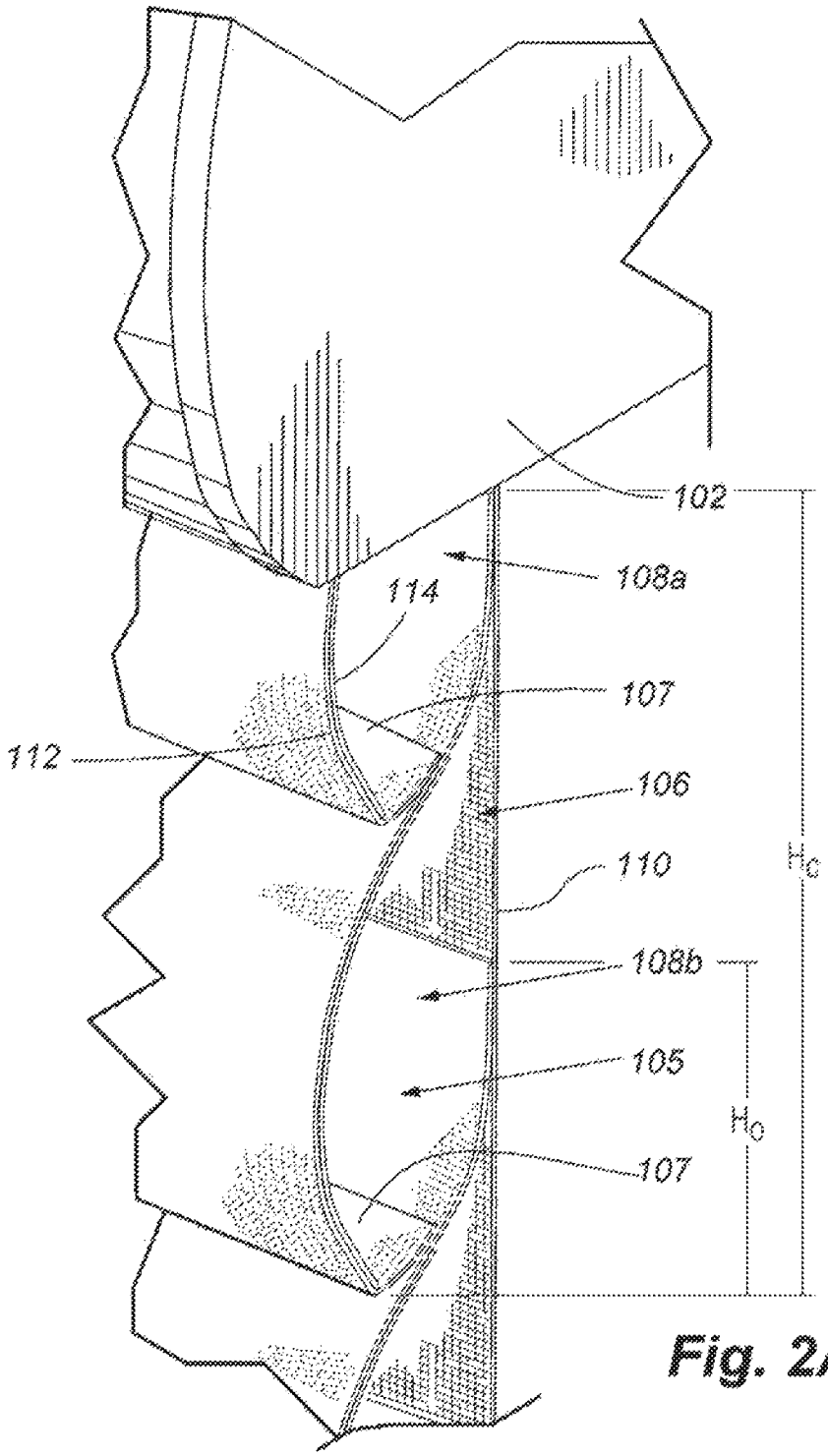
FIG. 2A is an enlarged isometric view of a first embodiment of the panel of FIG. 1.

FIG. 1 is a front isometric view of a cellular panel system 100. FIG. 2A is an enlarged isometric view of the cellular panel system 100 of FIG. 1. FIG. 3 is an exploded view of a cell of the cellular panel system 100 as shown in FIG. 2A. The cellular panel system 100 may include a head rail 102 or other support structure that can support a cellular panel 106 and an end or bottom rail 104 over an architectural opening. A support tube or roller may be positioned in the head rail 102, see, e.g., FIG. 7. The end or bottom rail 104 is operably connected to a terminal edge of the cellular panel 106, and provides weight to help tension the cellular panel when extended. The cellular panel 106 is configured to provide a covering for an architectural opening, such as a window, archway, etc.

The cellular panel 106 may include a plurality of cells 108 defined at least in part by a support sheet 110, a vane material 112, and a cellular support member 114. The vane material 112 and the support sheet 110 operably connected to one another to form a front side of the cellular panel 106. In some embodiments, the cells 108 may be stacked on top of another, and in other embodiments, the cells 108 may be spaced apart from one another (see, e.g., FIGS. 16, 17). The cells 108 extend laterally across the cellular panel 106 and may have open ends. In other examples, the cell 108 may extend vertically across the cellular panel 106.

Figure 2B:
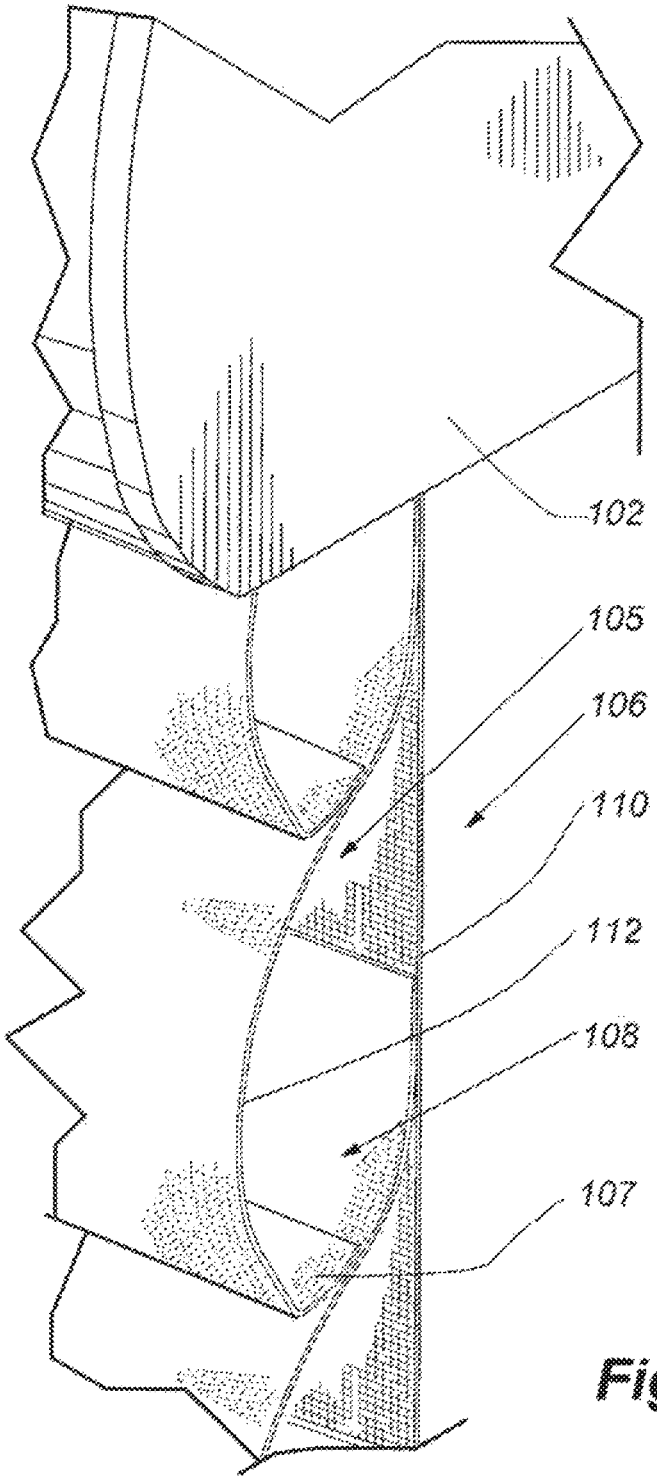
FIG. 2B is an enlarged isometric view of a second embodiment of the panel of FIG. 1.
Figure 4:
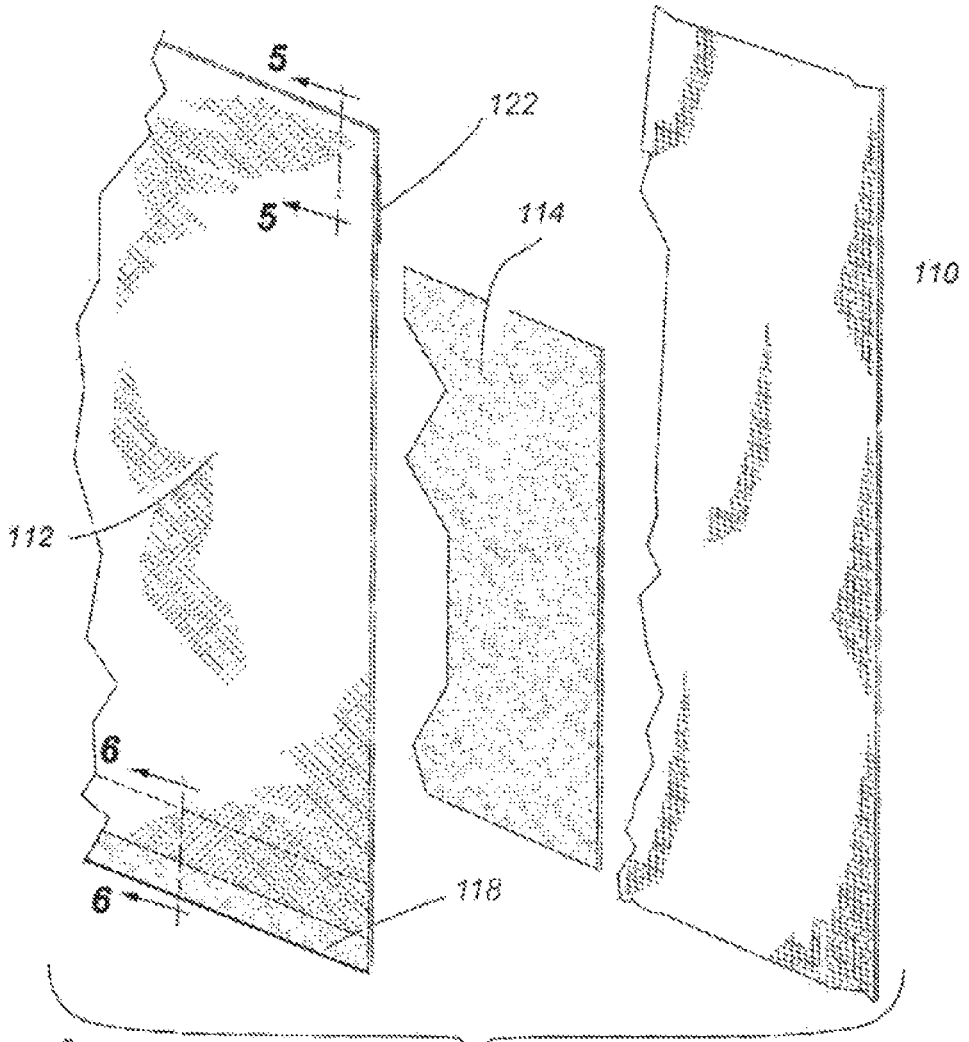
FIG. 4 is an exploded view of the cell of FIG. 1 prior to forming a cell support member.
Figure 5:
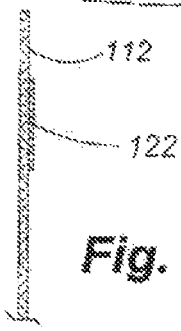
FIG. 5 is a cross-section view of a upper portion of a first material of the cell of FIG. 4 viewed along line 5-5 in FIG. 4.
Figure 6:
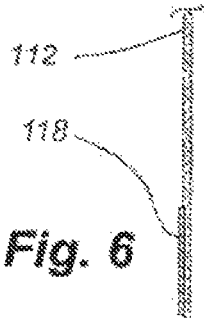
FIG. 6 is a cross-section view of a bottom portion of the first material of the cell of FIG. 5 viewed along line 6-6 in FIG. 4.

In addition to the vane material 112, as shown in FIGS. 2A, and 3A-3C the cells 108 include a cellular support member 114 that are resilient so as to allow the cells 108 to at least partially collapse when the panel 106 is wound around a support tube or roller, and spring or bias to the open configuration when the panel 106 is extended. A "collapsed" cell includes the structure where the support sheet and the vane are positioned to be closely adjacent to one another (or in contact or in partial contact) while on the roller in the retracted position. In the act of collapsing, the cellular support member may deflect from its formed curvature by a slight amount, or by a large amount, or it may not deflect appreciably. The cells 108 collapse when rolled up on the head roller or tube because, in one example, the cellular support member rolls up on the tube at a diameter approximately equal to set curvature of the cellular support member. If the cell support member were quite stiff, it would stay at substantially the same shape, rolled or not rolled. The cells would then be collapsed to the roller when rolled up (where the support sheet moves towards the cell support member/vane material), and opened at least in part by the curvature of the cellular support members when the shade is unrolled or straightened out. The curvature of the cellular support members would match or approximately match the curvature with which each was formed. The cellular support member 114 will be discussed in more detail below. Briefly, the cellular support member 114, which may be formed to determine the shape and height of the cells 108, and as shown in FIGS. 4-6 may have a first shape prior to forming and as shown in FIGS. 2A and 2B may have a second shape after forming. The forming of the cellular support member 114 will be discussed in more detail below.

Figure 7:
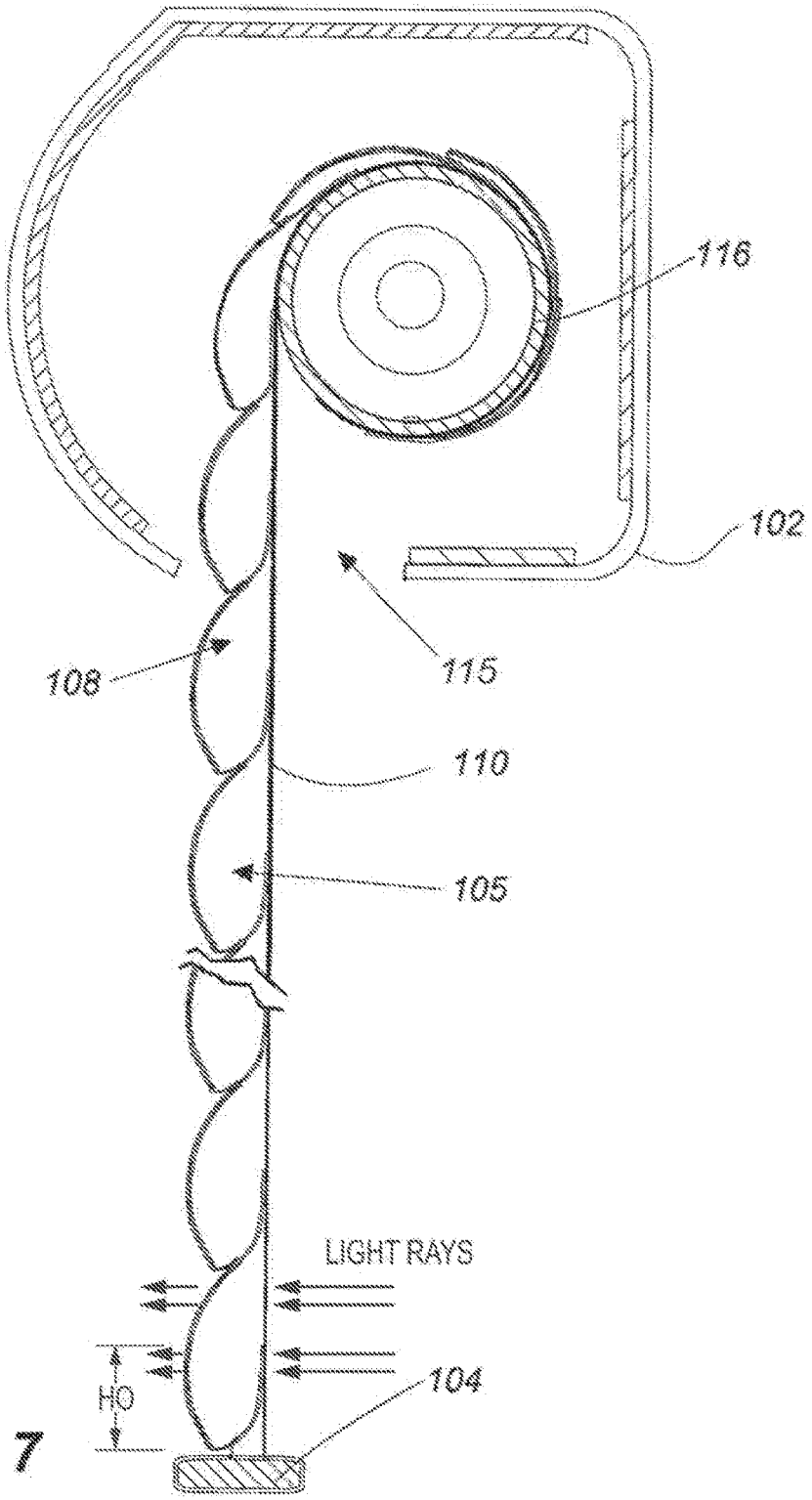
FIG. 7 is a cross-section view of the panel illustrated in FIG. 1 viewed along line 7-7 in FIG. 1.
Figures 7A, 7B, 7C:
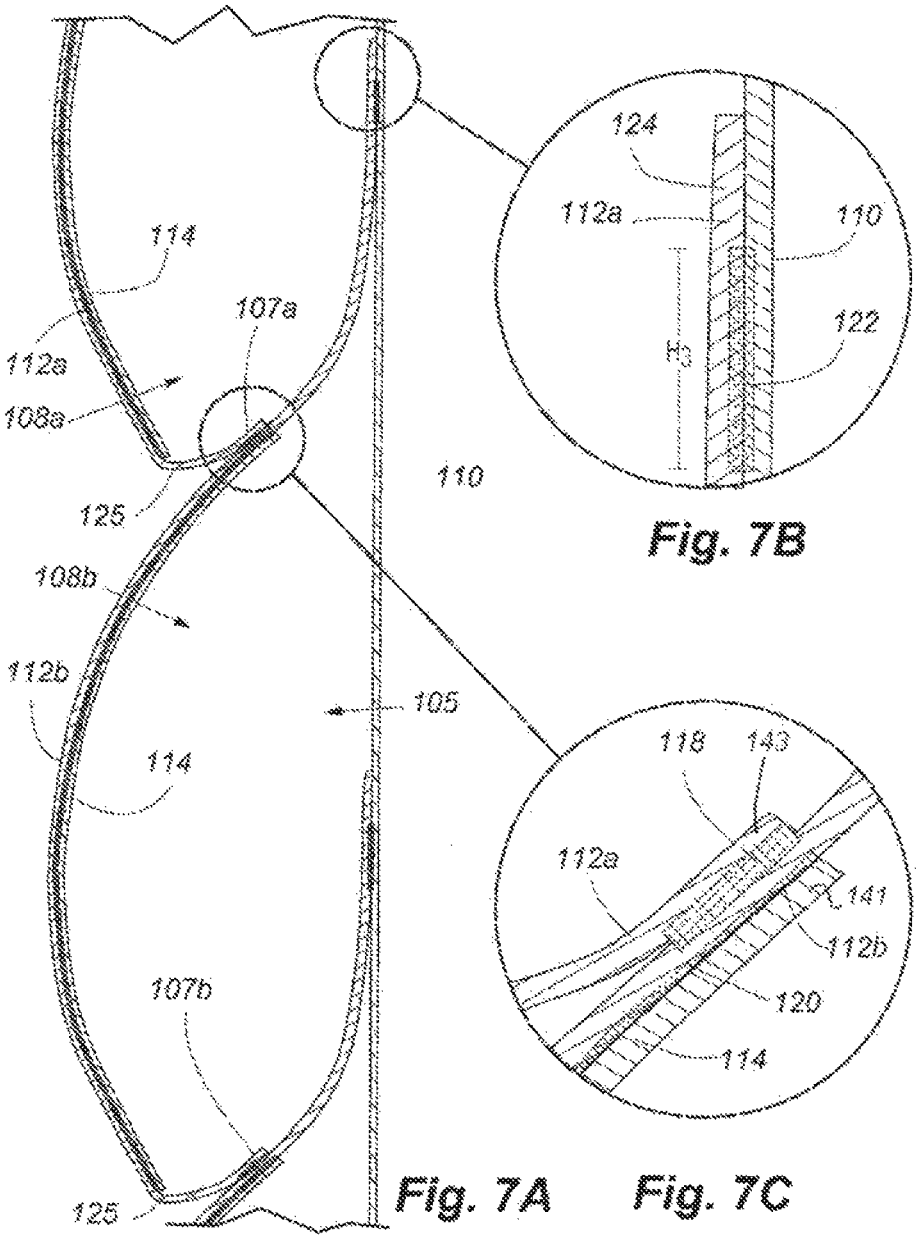
FIG. 7A is an enlarged view of cross-section view of the panel illustrated in FIG. 7.
FIG. 7B is an enlarged view of the panel of FIG. 7A illustrating a sheet connection between the first material and a support sheet.
FIG. 7C is an enlarged view of the panel of FIG. 7A illustrating a cell connection location and the cell support member operably connected to the first material.

The cellular panel system 100 will now be discussed in more detail. FIG. 7 is a cross section view of the cellular panel system 100 taken along line 7-7 in FIG. 1. FIG. 7A is an enlarged side elevation view of the cell 108 of FIG. 2. FIG. 7B is an enlarged view of the vane material 112 operably connected to the support sheet 110. FIG. 7C is an enlarged view of the panel of FIG. 7A illustrating a cell connection location and the cell support member operably connected to the first material. The cells 108 are configured so that each cell 108 may collapse and wind up in layers on the support tube 116. As shown in FIG. 7, the support tube 116 may be supported within the head rail 102, such that the head rail 102 may substantially cover or conceal the entire or a substantial portion of the support tube 116 and extend and retract the shade. The head rail 102 includes an opening 115 through which the cellular panel 106 may extend. The support tube 116 may be positioned within the head rail 102 such that the cellular panel 106 may be raised and lowered with respect to the head rail 102 through the opening 115. For example, as the cellular panel 106 is extended, the support tube 116 will roll, unwinding the cellular panel 106, which may then pass through the opening 115 past the head rail 102. Similarly, when the cellular panel 106 is retracted, the support tube 116 will roll in an opposite direction, winding the cellular panel 106 further around the support tube 116, retracting the cellular panel 106 through the opening 115.

In the embodiment illustrated in FIG. 7, the cellular panel 106 may be completely contained around the support tube 116 and substantially hidden from view within the head rail 102. This is beneficial as the head rail 102 may provide protection from ultra-violet light damage from sunlight, dust, and other elements. Additionally, as the cellular panel 106 may be substantially contained within the head rail 102 (as wrapped around the support tube 116), it may produce a more aesthetically pleasing and refined appearance. This is because there may be no extra or additional material exposed when the cellular panel 106 is in the retracted position. As the cellular panel 106 is wound around the support tube 116, its effective length decreases and it raised upwards with respect to the head rail 102. In some embodiments, the head rail 102 may be configured so that the entire length of the cellular panel 106 may be wound around the support tube 116 such that substantially none of the cellular panel 106 may be exposed. In these embodiments, the end or bottom rail 104 may be configured to be received through the opening 115, or may abut against the rim of the opening 115 when the cellular panel 106 is in a fully retracted position.

Figure 8:
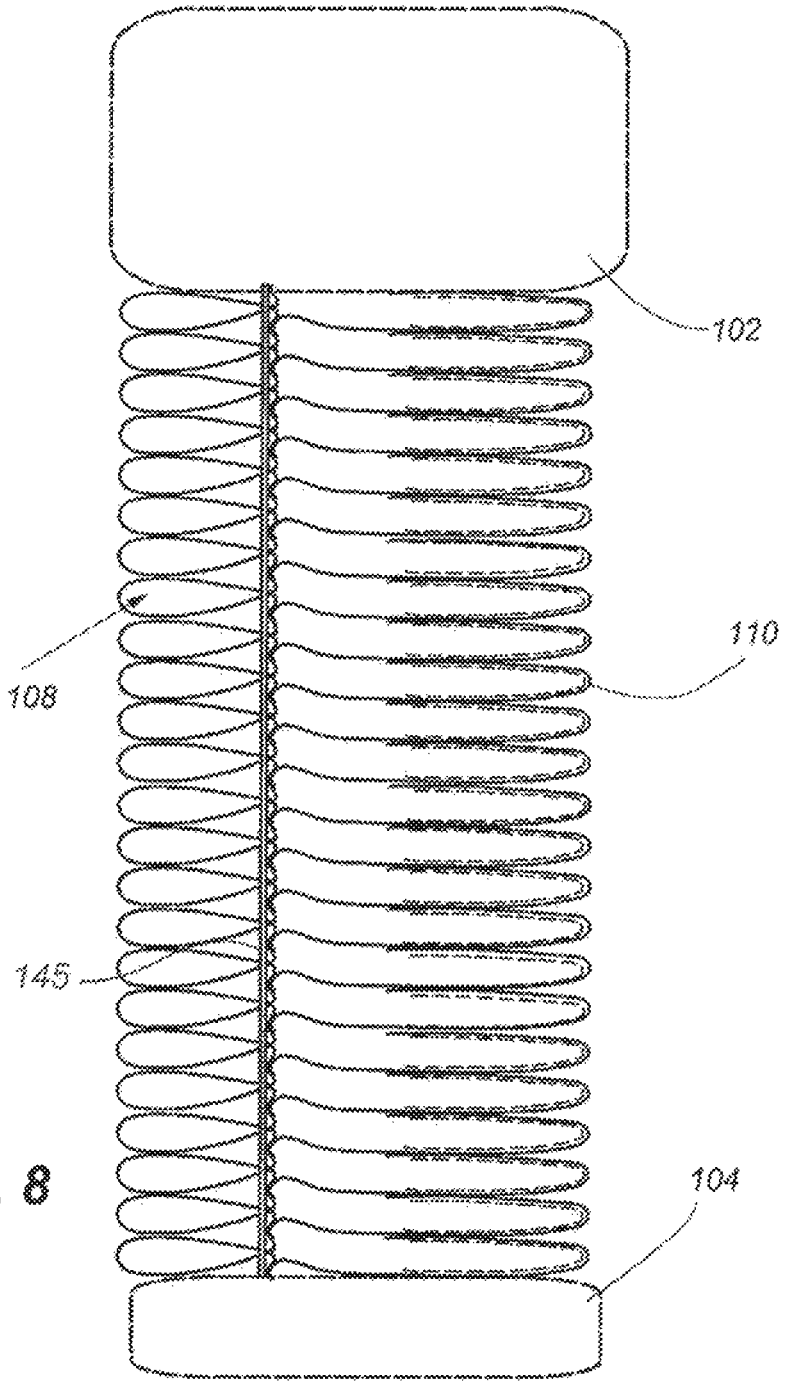
FIG. 8 is a side elevation view of the panel of FIG. 1 in retracted in a stacked configuration.

With reference to FIGS. 2A and 7A, the cells 108 each define an inner chamber 105 or void space, which is expanded when the cellular panel 106 is in the extended position and collapsed when in the retracted position (for example, rolled around the support tube 116, or stacked as shown in FIG. 8). The cellular panel 106 may be attached to the support tube 116 by an adhesive positioned between the top edge of the cellular panel and a line extending longitudinally along the length of the support tube. Other attachment means may also be used, such as double-sided tape, rivets, or even a top hem positioned within a receiving slot. The cellular panel 106 may be connected to the support tube 116 by a separate piece of material, plastic, or even laterally spaced cords or discrete links.

Figure 3A:
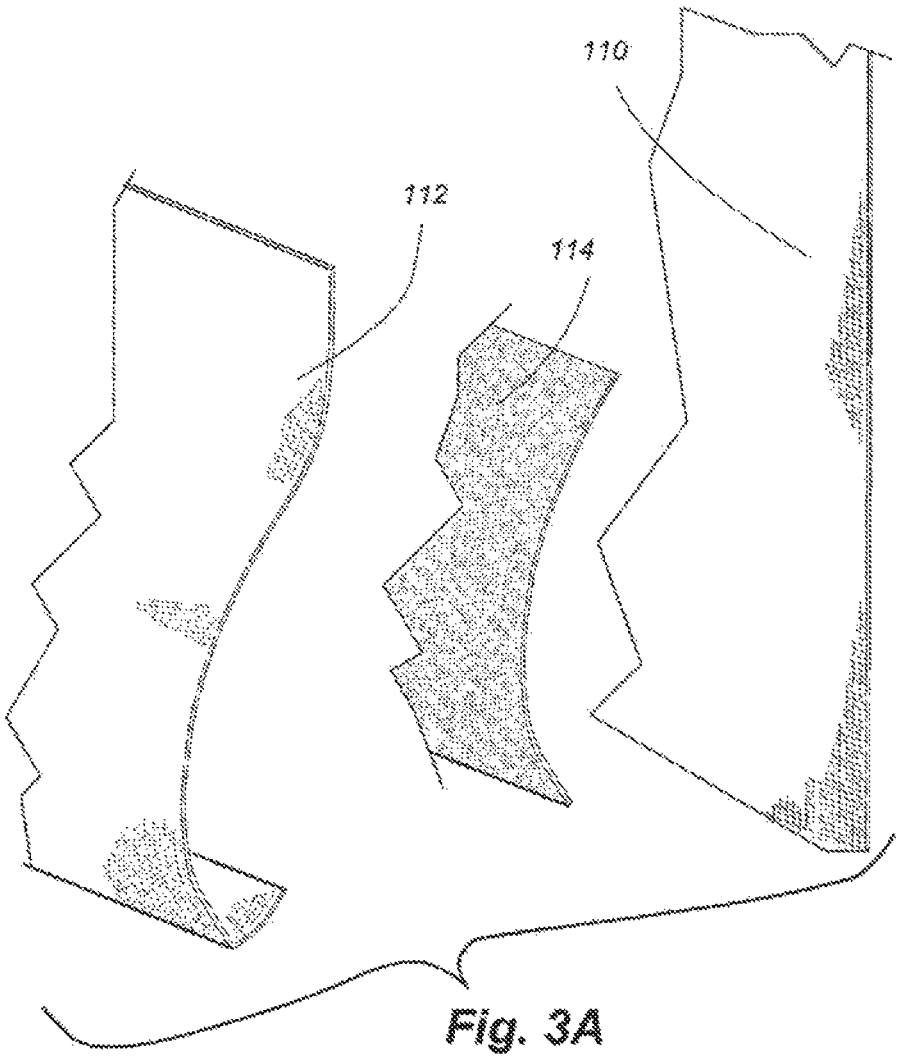
FIG. 3A is an exploded view of a cell forming a part of the panel illustrated in FIG. 2.
Figure 3B:
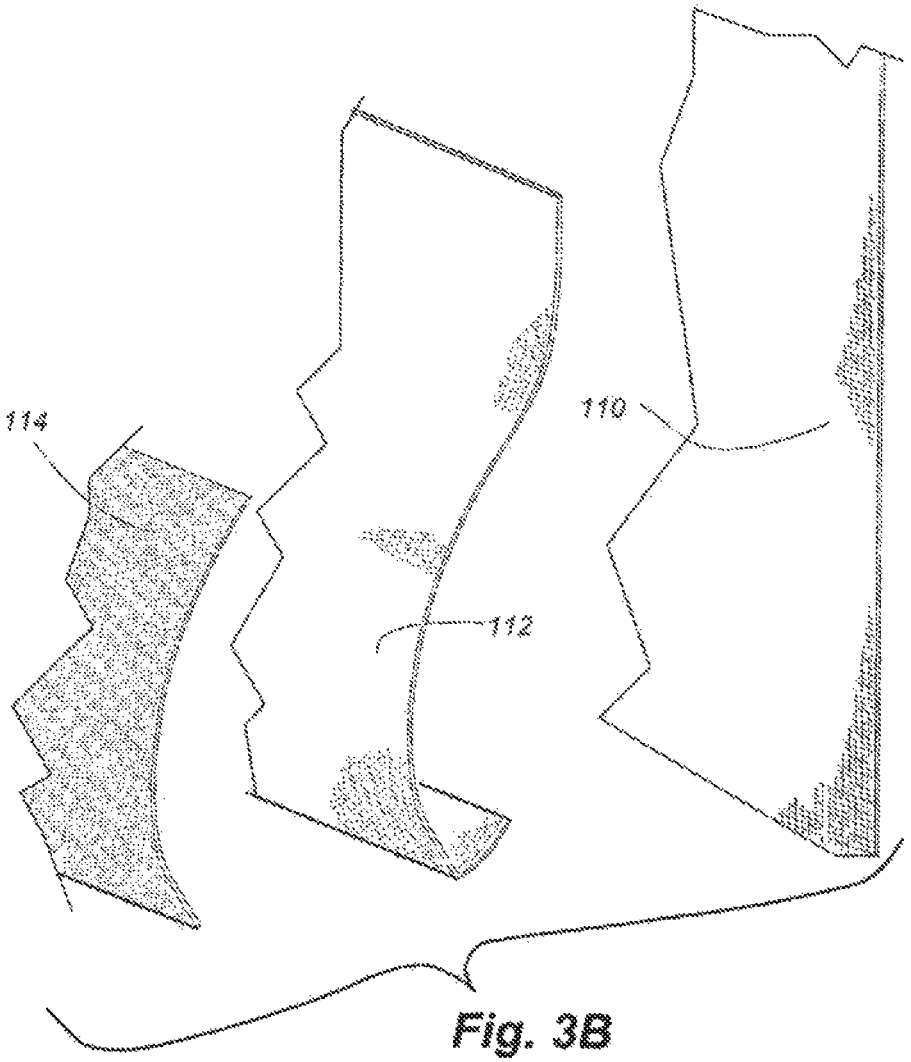
FIG. 3B is an exploded view of another embodiment of a cell forming a part of the panel illustrated in FIG. 2.

With reference to FIGS. 3A, 3B, and 7A, the cells 108 may be defined at least in part by the support sheet 110, the vane material 112 and the cellular support member 114. The vane material 112 and the support sheet 110, which may both at least partially define a part of one or more cells 108, may be substantially any material and may be the same as each other or different from each other. For example, in some embodiments, the vane material 112 and the support sheet 110 may be a woven, non-woven material, fabric, or a knit material. Also, the vane material 112 and the support sheet 110 may consist of separate pieces of material sewn or otherwise attached or joined together either in horizontally or vertical strips, or in other shapes.

Additionally, the vane material 112 and the support sheet 110 may have varying light transmissivity properties. For example, the vane material 112 and/or the support sheet 100 may be made of a sheer fabric (allowing a substantial amount of light through), translucent fabric (allowing some amount of light through), or a black-out fabric (allowing little or no light through). Both the vane material 112 and the support sheet 110 may also have insulating properties along with aesthetic properties. Further, the vane material 112 and the support sheet 110 may include more than one individual sheets or layers, and may be made of a different number of sheets or layers operably connected together. The vane material 112 may have a high level of drape (less stiff), or a low level of drape (more stiff), which may be selected for obtaining the appropriate or desired cell 108 shape. A more stiff vane material 112 may not result in as pronounced of a "S" shape as shown in FIGS. 7 and 7A. As explained in more detail below, a less stiff vane material may result in a more pronounced "S" shape than shown in FIGS. 7 and 7A.

In some configurations, such as shown in FIG. 2A and 7A, the cells 108 are formed by the support sheet 110, the vane material 112 of a first cell 108*a* and a second cell 108*b* adjacent to and immediately below the first cell 108*a*. The back surface of the top edge of the first vane material 112 of the first cell 108*a* is attached along its length, either continuously or intermittently, to a front surface of the support sheet 110 by a vane connection mechanism 122. The bottom of the vane material 112 of the first cell 108*a* is folded rearwardly to form a fold line 125 and a lower tab 107. Thus, the front surface of the first vane material 112 on the tab 107 faces rearwardly toward the support sheet 110. Each cell 108 has, as oriented when positioned over a window in a building, a front side (e.g., a side facing the room) that is defined as the portion between the top juncture (vane connection mechanism 122) of the vane material 112 with the support sheet 110 and the vertex or fold line 125 that forms the tab 107*a* (See FIG. 7A). Each cell has a back side (e.g., facing the window), defined as the portion of backing sheet 110 extending between its juncture (connection line 122) with the vane fabric at its top and continuing down to the vertex 125 again.

With specific reference to FIG. 2A, the cells 108 may have a dimension Hc extending from the top edge of the first vane material 112 to a bottom edge of the fold line 125. The dimension Hc represents the overall linear height of the cell 108 along the length of the support sheet 110 (vertical in this orientation, but may be a horizontal width where the invention is applied laterally to an architectural opening). Additionally, an adjacent lower cell may extend past the bottom edge of an upper cell 108 by an overlap dimension of Ho. The dimension Ho may be the distance between the bottom fold line 125 forming the bottom tab 107 and the top edge of the lower cell 108 vane material 112. The dimension Ho represents the linear height along the support sheet. It is contemplated that both Hc and Ho may be measured along the curvilinear surface of the cell also.

The value of Ho, whether as a percentage of Hc, or an absolute value, affects the external appearance of the shade, among other things. Where Ho is relatively large (ratio or dimension), it will result in less of the height (in reference to FIG. 2A) of the front vane material 112 of the cell 108 being shown. Where Ho is relatively low (ratio or dimension), it will result in more of the height of the front vane material 112 of the cell 108 being shown. The dimension Ho can be designed to be consistent for a length of a shade, or may vary, depending on the desired aesthetic effect.

Additionally, the value of the dimension Ho may effect the distance that the vane material 112 extends away from the support material 110, which would affect the volume of the cell, and thus its insulative properties. Other features of the shade structure may also work together with the Ho value to affect the internal volume of the cell 108. Also, the value of Ho affects how many layers the light must pass through as it strikes the rear of the support sheet 110. With reference to FIGS. 2A and 7, in the range of Ho, light rays transmitted from a first side of the panel 106 to a second side of the panel 106 pass through three layers (the support sheet 100 and the material forming two cells 108). Outside the range of Ho, light rays only pass through two layers, e.g., the support sheet 110 and the material forming one cell 108. This may affect the appearance of any "light stripe" on the shade. For example, light outside of the Ho range may be diffused by the support sheet 110, the vane material 112 and the cellular support member 114 of one cell and light within the Ho range may be diffused by the support sheet 110, the vane material 112 and cellular support member 114 for a first cell 108, as well as the vane material 112 for the lower adjacent cell 108. Thus, light rays passing through the panel 106 in the range of Ho may be more attenuated or diffused than light rays passing through the panel 106 outside of the range of Ho. This may create a "light stripe" or "shadow line" on the front side of the panel 106.

As shown best in FIGS. 7A-7C, the front surface of the lower tab 107 of the first vane material 112 is attached by a tab connection mechanism 118 to the front surface of the vane material 112 of the second cell 108*b*, adjacent to but below the top edge of the vane material 112 of the second cell 108*b*. The connection mechanism 118 may be by an adhesive, sewing, and/or stapling. The tab connection mechanism 118 or attachment line is lower on the vane material 112 of the second cell 108b than where the vane connection 122 of the lower second cell 108*b* to the support sheet, such that there may be gap or spaced formed between the tab 107 and the support sheet 110 when the cellular panel 106 is in the extended position. This gap may be reduced significantly or collapsed when the cellular panel 106 is rolled up or stacked.

Similar to the vane material 112 of the first cell 108*a*, the vane material 112 of the second cell 108*b* is attached by the vane connection mechanism 122 generally along a top edge to the front side of the support sheet 110. The top edge of the vane material 112 of the second cell 108*b* is positioned on the support sheet 110 at about the mid-point of the height H1 of the first cell 108*a*. This position may be higher or lower depending on the desired cell shape. The shape of the cell 108 is thus formed by the combination of the vane material 112 of the first cell 108*a*, the support sheet 110, and the top portion of the vane material 112 of the second cell 108*b*. The chamber 105 cross-section is approximately tear-drop shaped with a narrow top portion and a more bulbous bottom portion. In other embodiments, the shape of the chamber 105 may be differently configured.

FIGS. 4, 5, and 6 show the vane material 112, the cellular support member 114, and the support sheet 110 prior to forming. FIG. 4 shows the tab connection mechanism 118 positioned on the lower edge of the vane material 112. This tab connection mechanism 118 is positioned to allow the tab 107, once formed, to be attached to the support sheet 110, see, e.g., FIG. 7C. The fold line 125 (or crease) may be used to help define the tab 107, with the fold line 125 forming the vertex between the main body of the vane and the tab 107. FIG. 5 shows a tab connection mechanism 118 positioned on the top portion of the vane material 112. FIG. 6 shows the vane connection mechanism 122 used to attach the tab 107 to the backing sheet 110. The vane connection mechanism 122 is positioned a distance from the top edge of the vane material 112 in order to form a 124 (see FIG. 7A) or free edge of the vane material 112 above the location where the vane material 112 is attached to the support sheet 110.

Referring to FIGS. 7A-C, the vane connection mechanism 122 may have a height of H3, rather than a single line of connection having little width (a relatively thin line). Where the connection mechanism 122 has a height H3, it provides a bonding force between the vane material 112 and the support sheet 110 over its height H3 , which bonding force helps maintain the vane material 112 in closer proximity to the support sheet 110 even under the bending load biasing the vane material 112 away from the support sheet 110 caused by the vane material 112 of the adjacent upper vane. In these instances, the vane connection mechanism 122 may facilitate the cell 108 remaining in a more "closed" configuration when the shade is extended. This is because the height H3 may help prevent the vane material 112 from extending away from the support sheet 110, which could allow adjacent cells 108 to extend away from each other, and thus "opening the cells" and potentially releasing air, reducing the insulative characteristics of the cells 108.

With reference again to FIG. 7, as discussed above, the vane material 112*b* of the second cell 108*b* (in combination with the support sheet 110) may form a portion of the back wall of the first cell 108*a*. In these embodiments, the vane material 112 for each cell may generally form a backwards letter "S" (as shown in FIG. 7A), except that a top portion of the vane material 112 may be substantially flat or parallel with the support sheet 110. In other words, the vane material 112 has a generally concave shape with respect to the support sheet 110 in forming a bottom of the preceding cell 108, and a convex shape forming an outer sidewall of its respective cell 108.

The shape and height of the cell 108 and its respective chamber 105 may be determined by the length or height of the tab 107, as well as the transition from the front or main body of the vane material 112 to the tab 107. In some instances, the vane material 112*b* may bend at fold line 125 to form a tab 107*b* of the vane material. The tab 107*b* of the vane material 112*b* may be operably connected to the vane material 112 of an adjacent but lower cell 108 at a location near the top end of the support material 114, and may further enhance the transition in the curvature of the "S" shape as mentioned above. The tab 107*b* may be positioned such that a front surface (now facing the backing sheet 110) may be operably connected to the vane material of the following cell. The tabs 107*a*, 107*b* of each cell may be operably connected to the vane material 112 by the tab connection mechanism 118.

As discussed above, the vane material 112 may form a general "S" shape. In some instances, the point of transition between the curve being concave towards the backing sheet 110 (where the support member 114 is positioned on the vane), and concave away from the support sheet 110 (above the support member 114) is defined by where the vane 112 is bonded or coupled to the upper end of the cellular support member 114.

Referring to FIGS. 2A, 3A, and 7, the cellular support member 114 may support the vane material 112 and help form the shape of the cells 108. The cellular support member 114 may be a partially or substantially rigid material that may retain a particular shape. The cellular support member 114 is resilient in that it may be bent or flexed from its normal shape and return to its formed shape. For example, the cellular support member 114 may be any thermoformable material that may be heated to form a particular desired shape. The cellular support member may typically be approximately a 0.002 inch thick PET (polyester film). If made of another material (such as PVC), the thickness may be greater or less, with a thickness range of about 0.001 inches up to about 0.010 inches. Also, the cellular support member 114 may be re-formable, allowing the general shape of the cellular support member 114 to be altered repeatedly. Forming the cellular support member 114 is discussed in more detail below.

Figure 3C:
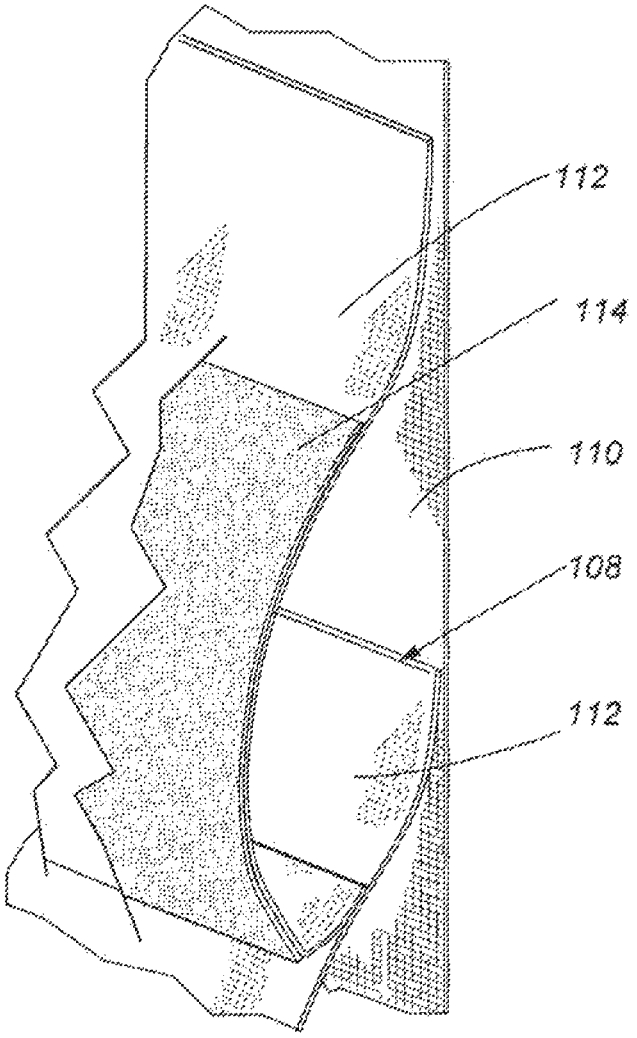
FIG. 3C is an exploded view of another embodiment of a cell forming a part of the panel illustrated in FIG. 2.

The cellular support member 114 may extend along at least a portion of the vane material 112 between the locations of the vane connection mechanisms 122 and the tab connection mechanisms 118. In some examples, the vane material 112 may be sufficiently stiff (have structural properties) so that the "S" shape is formed in spite of the weight of the cellular support member 114 and vane below it. In this way, the rigidity of the cellular support member 114 creates a twist or torque at its upper junction with the vane material 112, and the stiffness of the vane material 112 as it extends upwards from this point is levering the entire cell 108 assembly outwards (laterally away from the backing sheet 110), creating a deeper cell 108 than if the cell 108 had been defined by the curve of the cellular support member 114 itself. Referring to FIGS. 3C, 7A, and 7C, the cellular support member 114 and the vane material 112 may be operably connected together at support connection mechanism 120. The support connection mechanism 120 may be adhesive, fasteners, stitching, ultrasonic welding, stapling and the like. In other embodiments, the cellular support member 114 may be molded onto or impregnated into the vane material 112, as discussed in more detail below. In yet other embodiments, the cellular support member 114 may be slot coated or extruded directly onto the vane material 112, or otherwise operably connected to the vane material 112.

In some embodiments, the cellular support member 114 may be plastic, moldable laminate, fibers, moldable tape, adhesive, polyvinyl chloride, polypropylene, PET, polyester film, or the like. For example, the cellular support member 114 may be a thermoformable material such as a laminate material and may have an adhesive-like property when heated and then cooled. In other examples, the cellular support member 114 may be a partially thermoformable material that may have an increased adhesive-like property when heated and/or cooled, but may not completely loose its original shape or structure during heating and/or cooling. Furthermore, as shown in FIG. 3C, the vane material 112 may also be impregnated with the cellular support member 114.

Additionally, the cellular support member 114 may be configured to have aesthetic properties. Similar to the vane material 112 and the support sheet 110, the cellular support member 114 may have varying light transmissivity properties, e.g., the cellular support member 114 may be sheer, clear, opaque, or black-out. In other embodiments, the cellular support member 114 may be wood veneer or the vane material 112 may include a wood veneer. For example, a wood veneer may be attached to or form the vane material 112, which may then be operably connected to the cellular support member 114, or in instances where the vane material 112 may be impregnated with the support member 114, the wood veneer may form to or otherwise be connected to the outer surface of the vane material 112. Alternatively, the wood veneer may include a thermoformable material or may itself be impregnated with the cellular support member 114. A vane material of wood veneer may be positioned on the outside of the vane material with the cellular support material below it to create the shape. If the veneer was used without an additional cellular support material, it may be formed to have a curved shape by being wetted, then rolled up onto a forming roller or tube, and dried in the oven heat to set the curvature of the veneer. This formation of the veneer may or may not be repeatable to reform the wood veneer with a different curvature. Furthermore, the cellular support member 114 may have varying thicknesses, and in some embodiments, the cellular support member 114 may be as thin or thinner than the vane material 112. In these embodiments, the cell 108 may remain substantially flexible and may be able to flex, bend, and/or wrap around the support tube, although the cellular support member 114 may be a substantially/partially rigid material.

The cellular support member 114, as shown in FIG. 7A, is positioned on the inner surface of the vane material 112 of the first cell 108*a*, inside the chamber 105. In other instances, the cellular support member 114 may be positioned on an outer surface of the vane material 112. In some embodiments (see, e.g., FIG. 2B) the cellular support member 114 may be formed integrally with the vane material 112 or may be applied on the outer surface of the cell 108. FIG. 3A shows an exploded view of FIG. 2A. The cellular support member 114 is shown as a separate piece that is positioned in the vane material 112 inside the cell chamber. It should be noted that the cellular support member 114 may be positioned on the front surface of the vane material 112, as shown in FIG. 3B, or may be integrally formed with the vane material 112 (such as the vane material 112 being impregnated with a thermoformable material to allow it to become resiliently formed, as shown in FIG. 2B).

The cellular support member 114 may extend laterally along the full length of the cell 108 (across the width of the cellular panel 106). The cellular support member 114 may also extend along a portion of the length of the cell 108, or may include a plurality of cell support members 114 positioned at discreet positions along the length of the cell 108.

The cellular support member 114 may be adhered to the vane material 112 continuously along its entire length, continuously along a portion of its length, at spaced positions along its length, at the top and bottom edges of the support member 114, or in other locations. The top edge 141 of the cellular support member 114 of the second cell 108*b* may be aligned with a top edge143 of the tab 107 of the first cell 108*a* as shown in FIG. 7C, or may extend beyond or short of the free edge of the tab 107. In some embodiments, in the extended position of the cellular panel 106, a beak 149 (e.g., a "V" shaped space) is formed between the vertex or fold line125 at the bottom of a cell 108 and extension of the vane material 112 below where the tab 107 attaches to the vane material 112. In some instances, the cellular support member 114 may extend to align with an edge of the fold line 125, which may increase the sharpness of the fold line 125. This is because the tab 107 may fold around the rigid support member 114 rather than curve or bow in its transition.

Varying the height as well as the placement of the cellular support member 114 in the cell 108 may alter the shape of the cell 108 and chamber 105, as well as the distance or space between the support sheet 114 and the vane material 112 when the cell 108 is biased open. For example, a smaller cellular support member 114 may create a smaller distance between the support sheet 114 and the vane material 112, which may make the cell 108 appear "flatter" as compared to a cell 108 having a larger cellular support member 114. The length of the rear portion of each cell 108 is nearly as long as the length of the front section of each cell 108. In practice the front section may be a small amount longer because it rolled up on the outside of the rollup sandwich on the support tube 116, but typically this difference is small.

Figure 12:
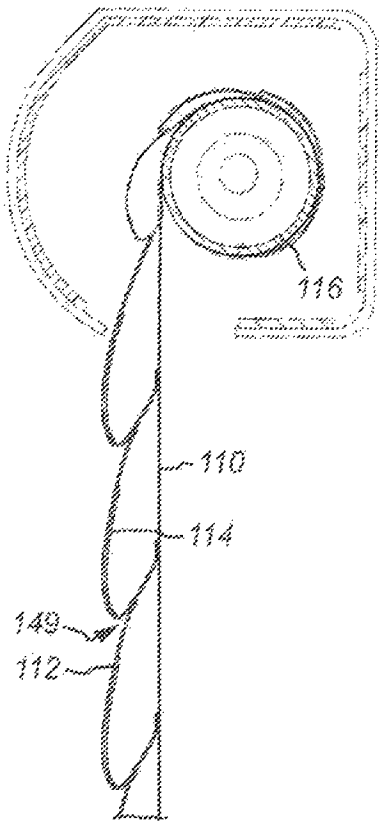
FIG. 12 is a side elevation view of a third embodiment of the panel of FIG. 1.
Figure 11:
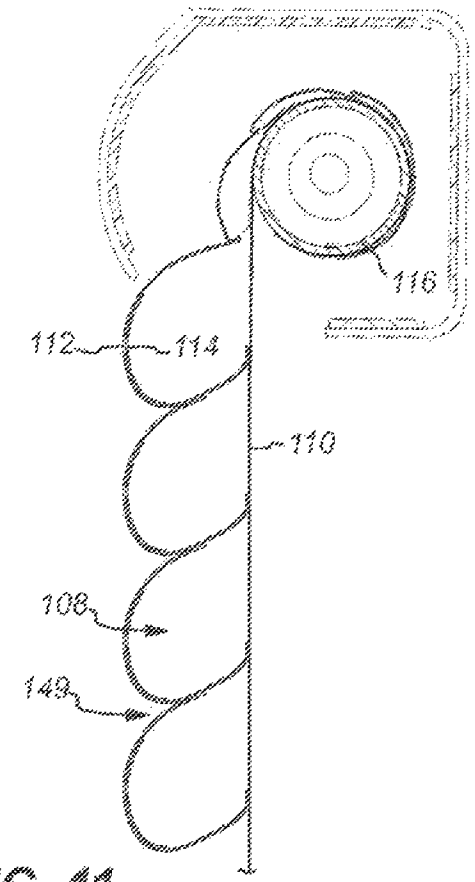
FIG. 11 is a side elevation view of a second embodiment of the panel of FIG. 1.

Once the panel 106 is unrolled from the support tube 116, and cells 108 are formed, the curvature of the cell support material 114 effectively shortens not the length of the front side of the cell, but the straight-line distance between the vertex or fold line 125 and the top juncture (connection line 122). There is some shortening of the length of the rear side of the cell 108 as well, but it is less because there is less total angle of curvature. The differential in these two distances opens the beak 149 at the bottom of each cell 108. Generally, where the cell support structure 114 has the same height, the beak 149 will be wider when there is a large angular curvature (smaller radius of curvature) of the cell support structure 114 as shown in FIG. 11, and the beak 149 will be smaller when there is a smaller angle of curvature (larger radius of curvature) of the cell support structure, as shown in FIG. 12.

Forming the Cellular Panel

Figure 15:
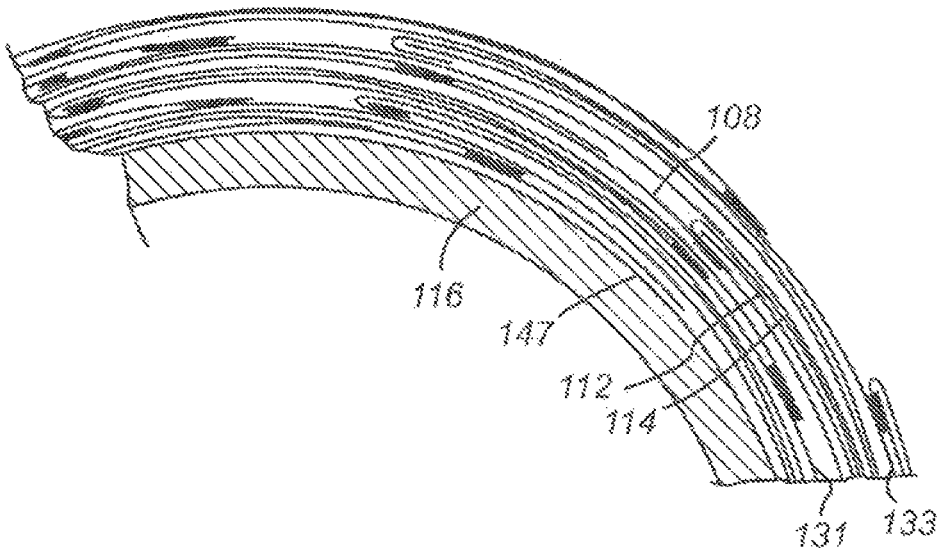
FIG. 15 is a partial cross section view of the panel of FIG. 1 in a retracted position viewed along line 7-7 in FIG. 1.

Referring now to FIGS. 3A, 4 and 15, the cellular panel 106 may be formed in a variety of different manners. However, in some embodiments, the cellular support member 114 is formed so that it may be shaped to approximate an arc of curvature or outer perimeter shape for the support tube 116 as modified by any underlying layers of the cellular shade already wound around the support tube 116. For example, as shown in FIG. 4, prior to being formed (as will be discussed in more detail below), the cellular support member 114 may be substantially flat (e.g., linear). However, as shown in FIG. 3A, after forming, discussed in more detail below, the cellular support member 114 may have a curvature or arcuate shape. This curvature or arcuate shape may be substantially the same as a portion of the perimeter of the support tube 116. In these embodiments, as the cells 108 are wound around the support tube 116, the cellular support member 114 may be wound around the support tube 116 although it may be substantially or partially rigid or resilient. Because the cell support members 104 are resiliently flexible, they may conform to various different shapes when wound up, such as a greater or lesser radius of curvature. For example, referring now to FIG. 15, in a retracted position, the cells 108 (including the cellular support member 114) may wrap around the support tube 116. As the cellular support member 114 may substantially approximate the same radius of curvature as the support tube 116 (due to the forming process, discussed below), each cellular support member 114 may wrap around a portion of the support tube 116 (as well as any cells 108 already wrapped around the support tube 116). Specifically, as the diameter of the support tube 116 and the rolled shade increases, the radius of curvature for the cellular support member 114 changes, so that the radius of curvature for cells 108 near the top of the shade have a tighter radius than those at the bottom.

Figure 9:
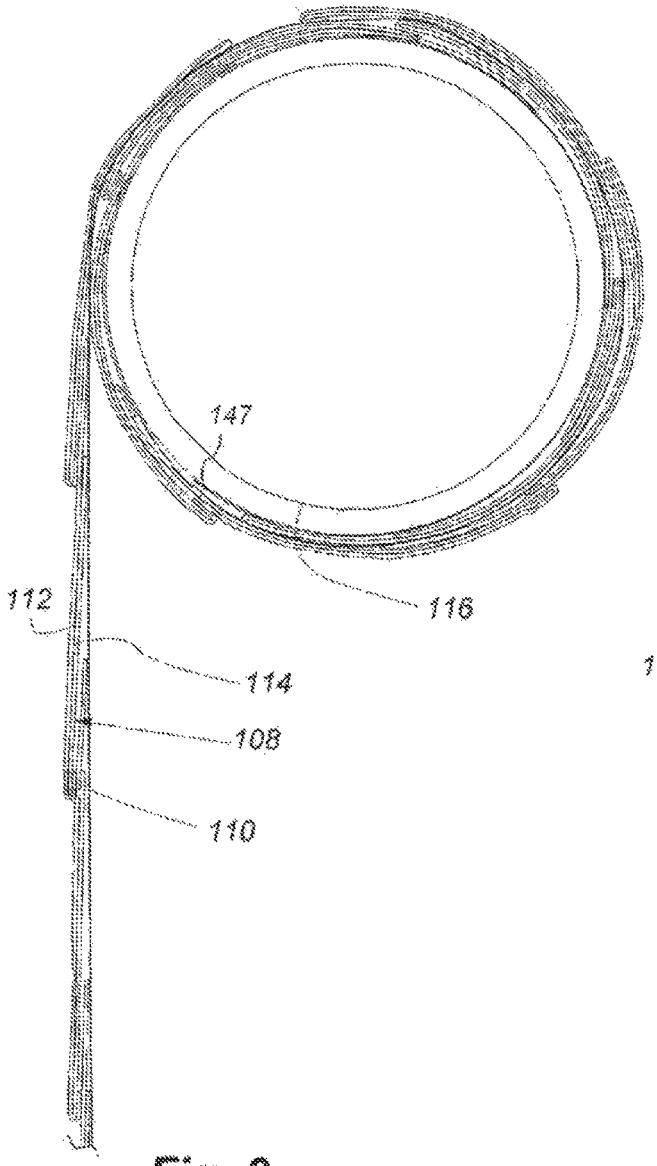
FIG. 9 is a side elevation view of the panel of FIG. 1 prior to the cell support member material being formed.

The cell support members 114 may be formed (or reformed) around the support tube 116 to create the desired formed shape. FIG. 9 illustrates the vane material 112 and the cellular support member 114 material operably connected together and partially wound around the support tube 116, but prior to the cellular support member 114 material being formed (see, e.g., FIG. 4). As can be seen in FIG. 9, before the cellular support member 114 is formed it may be substantially flat and thus the cells 108 may have little depth, i.e., each cell 108 may lay generally directly against the support sheet 110. Due to the at least partial resiliency of the cells support member 114, the cellular support members 114 may not break or crack while being wound around the support tube 116 prior to forming.

To form the panel the vanes 112 may be operably connected to the support sheet 110 and to each other (e.g., the tab 107 may be operably connected to the vane below) prior to the cellular support members 114 being formed and/or wound around the support tube 116. As an example, a process such as the process disclosed in PCT International patent application no. PCT/US2011/032624, filed Apr. 15, 2011, entitled "A Process and System for Manufacturing a Roller Blind," the entire disclosure of which is incorporated herein by reference, may be used to form the covering. For example, the connection members 118, 122, which may be adhesive, may be applied onto either the vane materials 112 or the support sheet 110. The cellular panel 106 may be formed by aligning the cellular support members 114 with the vane materials 112, applying the support connection mechanism 120 to the cellular support member 114 and the vane material 112. Then, the vane material 112 may be connected to the support sheet 110 by the vane connection mechanism 112 and the tab connection mechanism 118. For example, in instances where the vane connection mechanism 122 and the tab connection mechanism 118 are adhesive, the adhesive lines may be applied to the support sheet 110. Once the connection mechanism 118, 120, 122 are applied to one of the vane material 112, cellular support member 114, and/or support sheet 110, the panel 106 or portions thereof may be heated or otherwise (e.g., by a bonding or melting bar) to a first temperature (or otherwise activated) to adhere the vane material 112 and the support sheet 110 together.

As a specific example, a melting bar or a bonding bar may apply pressure and/or heat to activate the connection mechanisms 118, 120, 122 (which in some instances may be heat and/or pressure activated). In some instances, the connection mechanisms 118, 120, 122 may have a high activation or melting temperature, for example approximately 410 degrees Fahrenheit. This first temperature may be higher than a second temperature used to form the cellular support members 114, discussed below.

Once the vane material 112 and the support sheet 110 are connected together, the panel 106 may be wound around the support tube 116. After the cellular panel 106 is wrapped around the support tube 116, the support tube 116 and the cellular panel 106 may be heated to a second temperature, which may be less than the first temperature. For example during this operation, the panel 106 may be heated in this process to a temperature of approximately 170 to 250 degrees Fahrenheit, for up to approximately one and one-half hours. A temperature of 175 to 210 degrees Fahrenheit for approximately 15 minutes has been found to be suitable in some circumstances. Other temperatures and times may be acceptable as well.

As the cellular panel 104 is heated, the cellular support members 114 may become formable and conform to the support tube 116. With reference to FIG. 9, as the cellular support member 114 material is heated it may conform to the shape of the support tube 116, as well as operably connect to the vane material 112 (if not already connected together). Additionally, in some embodiments, the cellular support member 114 may conform to the shape of the support tube 116 plus any layers of the cellular panel 106 it may be wrapped around. For example, referring to FIGS. 9 and 15, the cell support members 114 for the cells 108 in an outer most layer 133 of the cellular panel 106 may have a larger diameter of curvature than the cell support members 114 for cells 108 at an inner-most layer 131.

In some instances, the vane material 112 may be a thermoset material which may be formed around a heated mandrel or support tube 116. The vane material 112, once formed or heated, may take a permanent shape having the curvature of the support tube 116. In this instance, the cellular support member 114 may be attached to or operably associated with the vane material 112 after it has been formed. In some instances, the thermoset material forming the vane 112 may be overcome by the rigidity of the cellular support member 114 such that the cell shape may be formed by the shape of the cellular support member 114. However, while forming the cellular support member 114, which may be a thermoformable material and have a lower forming temperature than the thermoset material forming the vane material 112, the thermoformable material may "release" or become pliant. Once the thermoformable material of the cellular support member 114 has released, it may then take the shape of the vane material 112, which due to the higher activation temperature, may not "release." In these embodiments, the shape of the cells 108 may be generally determined by the shape of the vane material 112, which may then be reheated with the cellular support member 114, to vary the shape of the cellular support member.

In some instances the connection mechanisms 118, 120, 122 may be activated at a higher temperature than the forming temperature of the support member 114. In these instances, the cellular support members 114 may be formed without substantially affecting the connection of the vanes 112 to the support sheet and/or to each other (by the tabs 107). Thus, the cellular support members 114 may be formed after the panel 106 has been substantially assembled and/or connected together. For example, the connection mechanism 118, 120, 122 may be high temperature pressure set adhesive, which may allow for the support member 114 to be formed by a heated processes, without substantially weakening or destroying a connection between the vane material and the support sheet. In this example, the vane connection mechanisms 118, 120, 122 may have a higher melting point than a material used to form the cellular support member 114. In one instance, the melting point for the vane connection mechanism 122 and tab connection mechanisms 118 may range between 350 and 450 degrees Fahrenheit and in a specific instance may be 410 degrees Fahrenheit. This allows the cellular support member 114 to be formed and possibly reformed at the necessary temperature without affecting the adhesion properties of the vane and tab connection elements.

Additionally or alternatively, the vane connection mechanism 118 may be a different type of adhesive and/or may be activated at a higher temperature than the support connection mechanism 122. As an example, the support connection mechanism 122 may be a high temperature crystal melt co-polymer and the vane connection mechanism 118 may be a hot melt adhesive which may melt and re-bond during the heating of the support member 114. In this embodiment, the vane connection mechanism 118 may have a similar melting point as the cellular support member 114 forming temperature, such that it may become at least partially flexible/pliant during forming the cellular support member 114, whereas the support connection mechanism 122 may remain substantially secured or bonded. In this manner, if the positioning of adjacent cells 108 changes during the formation of the cellular support members 114 (e.g., due to a change in curvature) the vane connection mechanism 118 may be re-bonded at a different location to the vane material 112 to account for the changes in shape of the cellular support member 114. However, in other embodiments, the vane connection mechanism 118 and the support connection mechanism 122 may have substantially the same, if not the same, activation or melting temperatures, so that the connection points for the cells 108 may remain in place while the cellular support member 114 is formed.

After heating the cellular panel 106, the support tube 116 may be cooled. During cooling, the cellular support members 114 stiffen or harden in the shape of the support tube 116. This is because the cellular support members 114 may become at least partially formable or moldable when heated, but after the heating process the cellular support members 114 may harden back into a substantially the shape of the support member.

Figure 10:
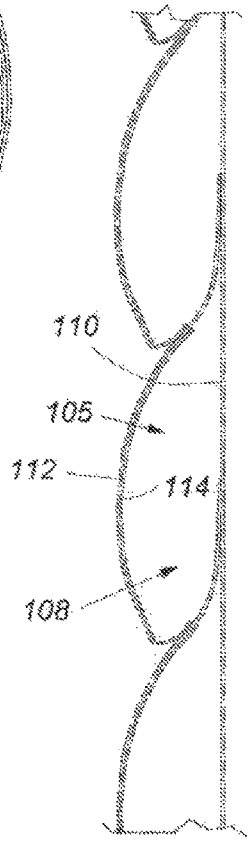
FIG. 10 is an enlarged side elevation view of the panel of 1 after the cell support member material is formed.

Once cooled, the cellular support member 114 maintains the general shape of the support tube 116 and thus be slightly curved. Thus, after forming of the cellular support member 114, the cells 108 may be curved as shown in FIG. 10. This allows the cellular support member 114 to be wrapped around the support tube 116 when in a stored or retracted position because the cell support members' 114 shape generally conforms to the support tube 116. The cell support members 114 then, as described below, help bias their respective cells 108 to an open position when unwound from the support tube 116, as shown in FIG. 10.

For example, in some embodiments, the cellular support member 114 may be shaped generally as a portion of a "C", thus, as the cellular panel 106 wraps around a cylindrically shaped support tube, the cellular support member 114 may conform to a portion of the perimeter of the support tube 116. This facilitates the cells 108 to be wrapped or rolled around the support tube 116 in the retracted position, and also to bias open as the cellular panel 106 is unwound from the support tube 116. The resistance of the cellular support member 114 and its connection to the support sheet and lower vane aids in the automatic-open features. The stiffness of the curve-formed cellular support material helps cause the cell to re-open (the support sheet and the vane material to move apart from one another) to its expanded shape when unrolled from the roller. Thus, the cells 108 may have insulative properties as they may trap packets of air, although they may be completely or partially collapsed when in a retracted position (e.g., wound around the support tube 116).

The cellular panel 106, while originally formed around a support tube 116, may be disconnected from the original support tube and re-attached to a different support tube (such as having a larger or smaller diameter support tube) for subsequent reforming. The top edge of the cellular panel 106 may be attached to a new support tube 116 with a line of adhesive 147, or by a hem received in a slot, or other means. Also, if a portion of a cellular panel 106 is separated from a larger length of cellular panel 106 by a lateral slice along the width of the cellular panel 106, the now separate cellular panel 106 may be attached to a new support tube (such as by the means described herein) having the same diameter as the original support tube, or it may be attached to a new support tube having a different diameter than the original support tube and be reformed.

After the cell support members 114 are formed and the cellular panel 106 is operably connected to the support tube 116, a panel section of different widths may be formed by cutting the combination of the wrapped cellular panel 106 and support tube 116 to the desired length. In these embodiments, end caps or the like may be placed on the terminal ends of the support tube 116 creating a refined appearance. For example, a single support tube 116 may be used to create multiple different panels or shades for a variety of different architectural openings.

Operating the Cellular Panel

Operation of the cellular panel 106 will now be discussed in more detail. As discussed above, the cellular panel 106 may be wound around the support tube 116 or other member (e.g., rod, roller, mandrel, etc.). See, for example, FIGS. 7 and 15, among others. As the cells 108 are wound around the support tube 116, the cells 108 may each collapse so that each cell 108 may substantially conform to a perimeter of the support tube 116. This is possible as the support sheet 110 may wrap tightly around the support tube 116, and as it does so, the support sheet 110 pulls the top of each cell 108 with it around the support tube 116. As the support tube 116 winds (or rolls), the cell support members 114 may then be forced to conform to the effective perimeter of the support tube 116 and underlying layers of the cellular shade. Thus, the cellular support members 114 may be collapsed to lie adjacent the support sheet, substantially collapsing the chamber 105 formed within each cell 108 when the cellular panel 106 is in the extended position.

Continuing with reference to FIG. 7, as the cellular panel 106 is unwound from the support tube 116, e.g., extended, the cells 108 bias or "pop" open. As the support tube 116 is rotated to extend the cellular plane, the support sheet 110 also unwinds. As the support sheet 110 unwinds, the cell support members 114 also unwind from around the perimeter of the support tube 116. On the support tube 116, the shade material is collapsed into closely spaced layers (e.g. See FIG. 15), and the cell support members 114 generally maintain a same or similar amount of curvature as when in the extended position. As shade or panel 106 is extended as the support tube 116 rotates accordingly, the backing or support sheet 110 hangs substantially vertically downwardly. The vane material 112, under the force of the cellular support member 114, converts to the open configuration and reforms the chamber 105 of the cell 108. This expanded or open shape is caused by the cell support material 114, in combination with the structural effect on the vane material 112 of the top and bottom connection points, as described in more detail below. To the extent that any of the cell support members 114 are deformed when rolled up on the support tube 116, the resiliency of each of the cell support members 114, upon unrolling, biases the vane material 114 to its formed shape, e.g., similar to a "C" to create the chamber 105. The cellular support member 114 and the vane material 112 thus extend away from the support sheet 110 to form the cell 108 and its interior chamber 105.

In the cellular panel 106 each cell 108 may be operably associated with each other cell 108 as described above. For example, as shown in FIG. 7A and described above, the first cell 108*a* may be operably connected to the second cell 108*b*. In these embodiments, a portion of the vane material 112*b* for the second cell 108*b* may extend up behind the first cell 108*a* and connect to the front surface of the support sheet 110. This top edge of the vane material 112*b* for the second cell 108*b* may be connected to the front side of the support sheet 110 by the vane connection member or rear connection mechanism 122. The vane connection mechanism 122 may be approximately at a mid-point of the first cell 108*a*. In these embodiments, the support sheet 110 may form a top back portion of each cell 108 and the vane material from an adjacent cell 108 may form a bottom back portion of each cell 108. The vane material 112 may connect to the support sheet 110 such that there may be a leg 124 or free edge that may extend above the vane connection mechanism 122.

Referring to FIGS. 7A and 7B, while the leg 124 may (but is not required to) assist the cell 108 in expanding into an "open" position (i.e., transitioning from a collapsed position to an expanded position), the leg does provide dimensional tolerance for applying a connection mechanism 122 (such as a glue or adhesive line) along the edge. A longer length of the leg 124 extending above the vane connection mechanism 122 indicates that the connection location 122 is positioned lower on the vane material 112 and closer to the top of the support member 114 of the adjacent lower vane, as well as closer to the connection with the next cell. Since the distance between the vane connection mechanism 122 and the top of the support member 114 is shorter, it is more stiff (compared to a longer distance), and itself may bias or bend outwardly away from the backing sheet 110 more robustly than if the distance was longer. In combination with the support member 114, the cell 108 then may bias open more readily. Note that the cellular support member 114 may be made of substantially rigid material also since when in the rolled-up position on the support tube 116, it maintains substantially the same shape as when it is in the extended position. It is also contemplated that the cellular support member 114 may be less stiff, and thus may flex somewhat when opening the vanes when unrolled or extended. This example of a less stiff cellular support member 114 may take some set in this state of flexure when extended, but will reform to the general tube diameter and original set curvature when rolled up on the support tube. In other words, this more flexible cellular support structure may be formed to its desired shape when rolled upon the support tube 116, and may still take a slightly different set shape when unrolled due to the weight of the shade panel and the forces acting thereon. Also, in a different example, even if the cellular member 114 may be deformed somewhat when rolled around the support tube 116, due to its resiliency the cellular support member 114 may return to its formed shape when unrolled, and thus being rolled onto the support tube 112 may not appreciably change the shape of the cells 108 when extended.

In some instances the cellular panel 106 may also be retracted in a stacked configuration, rather than wound around the support tube 116. FIG. 8 illustrates the cellular panel 106 retracted in a stacked position. The cellular panel 106 may be retracted and stored in a stacked position (rather than wound around the support tube 116). In this configuration, each cell 108 may be positioned in a relatively straight alignment vertically underneath one another. For example, the end rail 104 (or terminal cell) may be moved vertically upwards towards the head rail 102 or support tube 116. This may be accomplished by one or more support cords 145 extending from the head rail 102 (or other suitable structure at or near the top of the shade) through the length of the panel 106 and connecting to the end rail 104. The support cords 145 are then actuated to pull the end rail 104 up toward the head rail 102, thus stacking the cells 108 as shown. Many known mechanisms are suitable for drawing the support cords 145 to the head rail 102. And thus, rather than winding around the support tube 116, the cellular panel 106 may stack vertically in a line. Thus, each cell 108 may collapse vertically on top of each adjacent cell 108.

Alternative Examples of the Panel

Figures 7D, 7E, 7F:
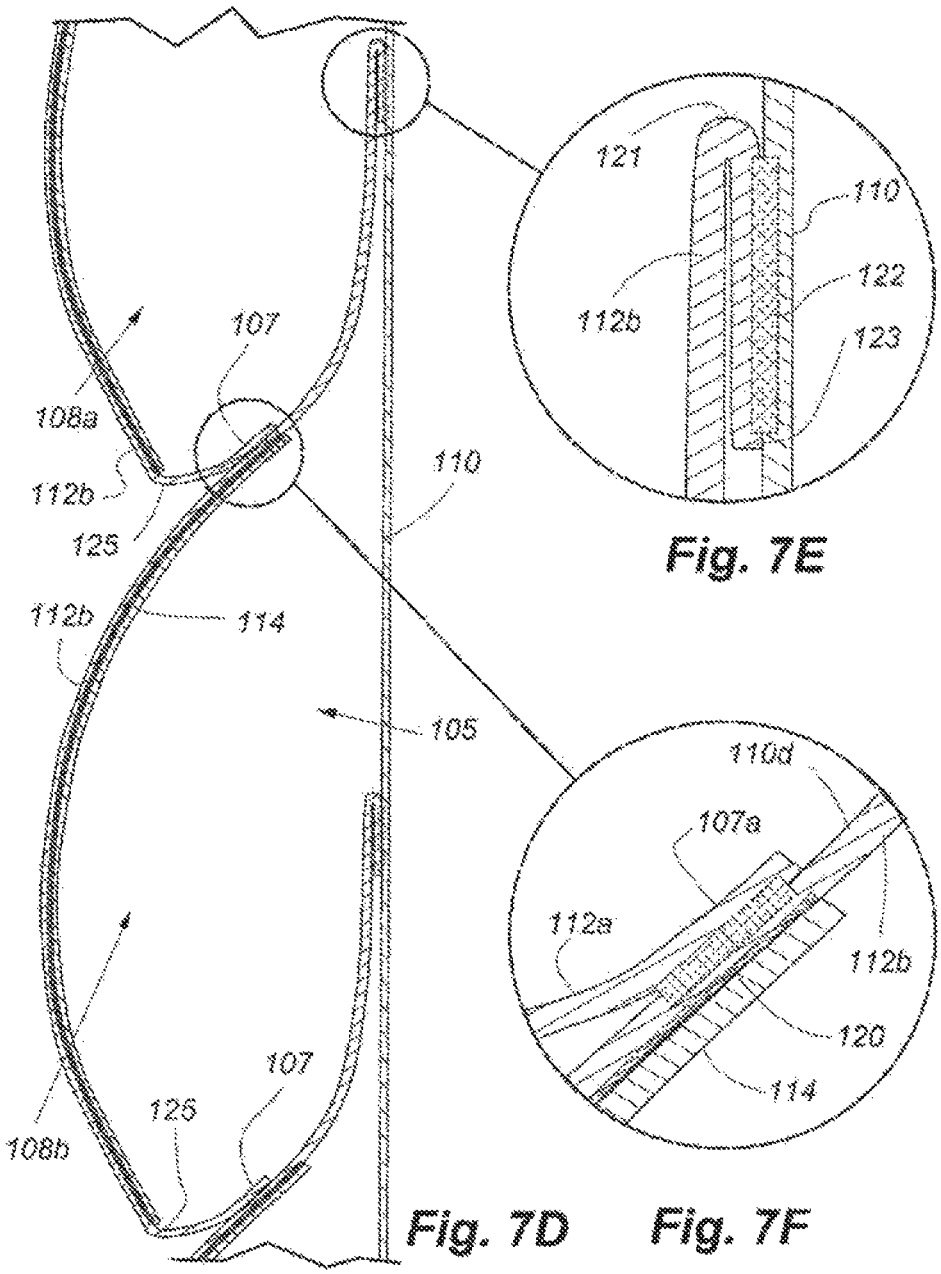
FIG. 7D is an enlarged view of the cross-section view of the panel illustrated in FIG. 7 illustrating a second embodiment of the sheet connection location between the first material and the support sheet.
FIG. 7E is an enlarged view of the panel of FIG. 7D illustrating the second embodiment of the sheet connection location between the first material and the support sheet.
FIG. 7F is an enlarged view of the panel of FIG. 7D illustrating the cell connection location and the cell support member operably connected to the first material.

FIGS. 7D-7F illustrate another example of the cellular panel 106. As shown in FIGS. 7D and 7E, the second vane material 112*b* of the second cell 108*b* may be folded over itself at fold line 121 to form an upper tab 123. The upper tab 123 connects to the support sheet 110. For example, the upper tab 123 of a top end of the vane material 112 may fold at fold line 121 and then be connected to the support sheet 110. In these embodiments, the fold line 121 may be approximately at a mid-point of each cell 108. The fold line 121 may not be heat-set and thus may not have a hard crease, which may encourage the formation of a deeper cell 108 by biasing the top portion of the vane material 112 away from the support sheet 110 when the panel 106 is in the open or extended position. Or, alternatively, the fold line 121 may be heat-set and hard-creased, which may result in a less-deep (more shallow) cell 108.

Figure 13:
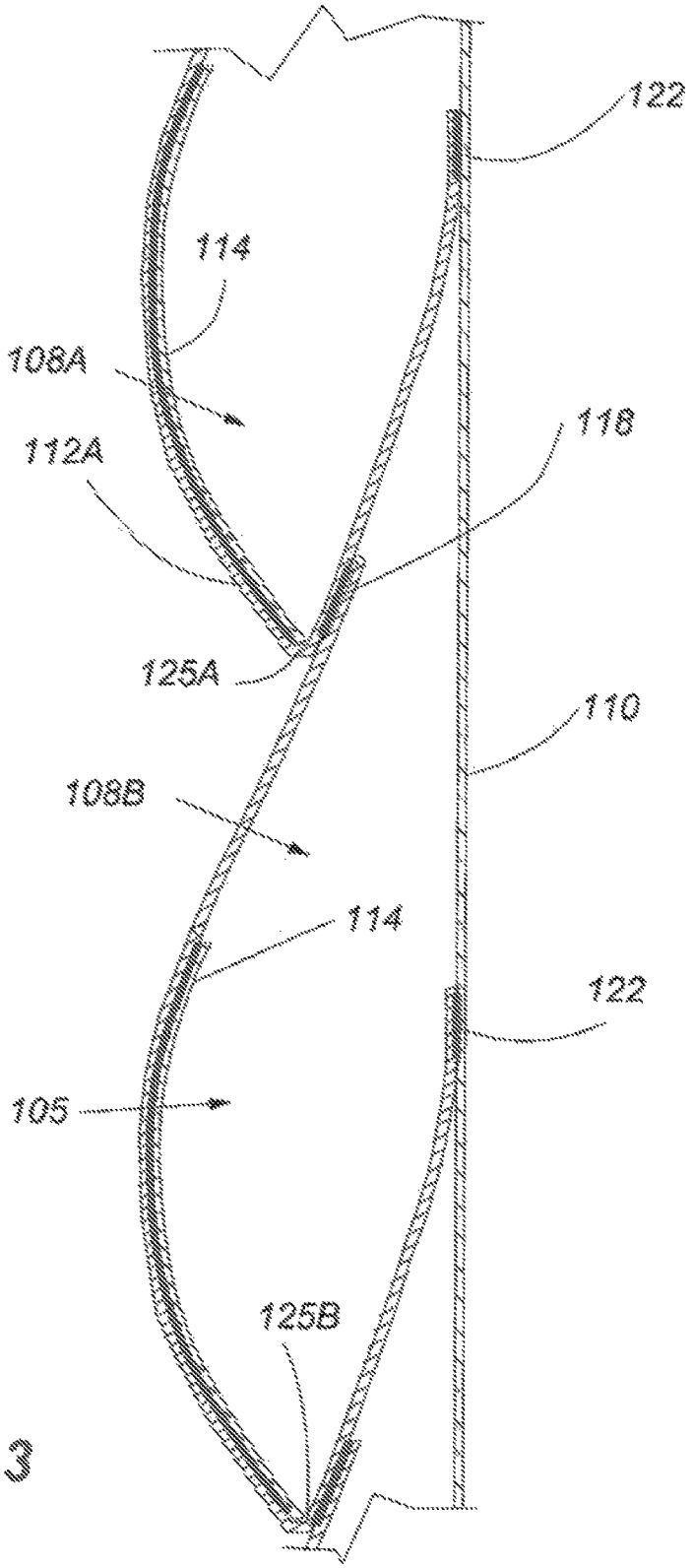
FIG. 13 is an enlarged cross-section view of the panel illustrated in FIG. 1 viewed along line 7-7, illustrating a third embodiment of a cell support member and connection location.

FIG. 13 illustrates another embodiment of the cellular panel 106. In this embodiment, a terminal end of the vane material 112 for each cell 108 may connect to the support sheet 110. This is different than the embodiment illustrated in FIG. 7A, in which a top end of the vane material 112 connects to the support sheet 110. In the embodiment illustrated in FIG. 13, a top end of the vane material 112*b* for the second cell 108*b* may be operably connected at the cell connection location 118 to the first cell 108*a*, which may be near a fold line 125*a* of the vane material 112*a* for the first cell 108*a*. The vane material 112*b* for the second cell 108*b* may then curve outward and downward with respect to the support sheet 110 until a fold line 125*b*. At the fold line 125*b*, the second vane material 112*b* extends upwards towards a top of the cell 108*b* and connects to the support sheet 110. The second vane material 112*b* may form a "U" or "V" shape as it folds around the fold line 125*b* to connect to the support sheet 110. Thus, the vane material 112 may form a substantial portion of each cell, whereas in FIG. 7A, the vane material 112 for adjacent cells may (in combination with the vane material for the respective cell) form a significant portion each respective cell 108.

In some embodiments, the shape of the cells 108 may be varied. The shape of the cells 108 may be modified by changing the height of the vane material 112 and/or the cellular support member 114. For example, the diameter of the support tube 116 may be increased in order to increase the radius of curvature of the cellular support member 114 during forming, which may correspondingly change the shape of the cells 108.

Additionally, the shape of the formed cellular support member 114 may also vary the appearance of the cells 108. FIGS. 11 and 12 illustrate different shapes for the cells 108 based on the radius of the support tube 116 (or other member used to form the cellular support member 114). The radius of curvature of the support tube 116 may be larger or smaller, changing the curvature of the cellular support member 114. Generally, it has been determined that the height dimension of the cellular support member 114 may beneficially be one-half the circumference of the support tube 116. Other ratios are acceptable, but this ratio has been found to provide acceptable appearance of the panel 106 over the typical heights of the panel or shade structure.

Also, it should be noted that in some embodiments, the shape of the cells 108 may be varied by varying the attachment locations of the vane material 112 to the support sheet 110. For example, two cells having approximately the same radius of curvature may appear different depending on a height between a top connection point and a bottom connection point. Continuing with the example, the first cell may appear more "droopy" than a second cell if the first cell has an increased height between the top connection point and the bottom connection point to the support sheet.

Figure 14:
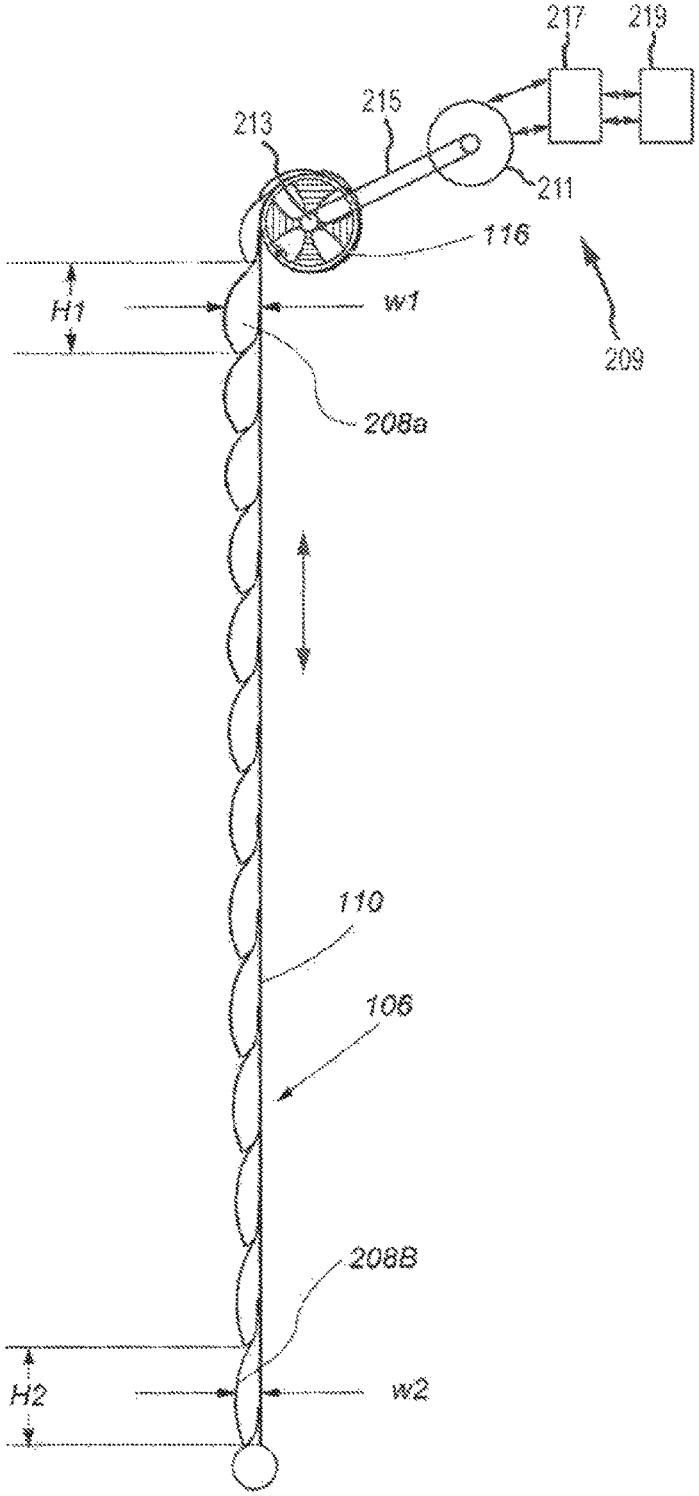
FIG. 14 is a side elevation view of a fifth embodiment of the panel of FIG. 1.

In some embodiments, during the forming process, cells 108 on the outer layers of the wrapped configuration may have a cellular support member 114 with a larger radius of curvature than the cells 108 in the inner layers 131 of the wrapped configuration. See FIG. 15. The cells 108 near the bottom of the cellular panel 106 are the ones in the outer layers 133. Therefore, as shown in FIG. 14, the cell support members 114 near the bottom of the cellular panel 106 may appear to have a taller height dimension (due to a more shallow curve) than the cells 108 towards the top of the panel 102 even through the cell support members 114 have the same unformed (FIG. 4) height dimension. For example, as shown in FIG. 14, a top cell 208*a* may have a first height H1 and a first width W1. The height H1 may correspond to a length of the cell 208*a* when the cellular panel 106 is in an extended position. The width W1 may correspond to a width of the cell 208*a*, for example, a distance between the support sheet 110 and the vane material 112 of the cell 208. This width W1 may also correspond to a radius of curvature; for example, as the radius decreases, the width W1 may become wider as the vane material 112 may be pushed further away from the support sheet 110.

Still referring to FIG. 14, the bottom cell 208*b* may have a height H2 and a width W2. The height H2 and the width W2 of the bottom cell 208*b* may be different than those dimensions for the top cell 208*a*, e.g., the height H2 may be greater than the height H1 and the width W2 may be smaller than the width W1. The bottom cell 208*b* may have a larger height H2 dimension because the cellular support member 114 may be formed in the outer layer 133 when wrapped around the support tube 116. Thus, the formed diameter of the cellular support member 114 is larger than the forming diameter of the top cell 208*a*. This may cause the width W2 to be slightly smaller than the first width W1. For example, as the height H2 of the bottom cell 208*b* increases the width W2 may decrease. These dimensional differences may be less noticeable on a cellular panel 106 having a relatively smaller height as compared with those cellular panels 106 having a larger height (e.g., dimension of the cellular panel 106 as measured from its top edge to a bottom edge).

However, in other embodiments, for example, the heights of the top cell 208*a* and the bottom cell 208*b* may be substantially the same. These embodiments may be created by altering an unformed length of material for the cellular support member 114. By altering the unformed total length of the cellular support member 114 prior to forming based on the position of the cellular support member 114 in the length of the cellular panel 106, the cell 208*b* may be shorter. However, this may allow the top and bottom cells 208*a*, 208*b* to appear to have substantially the same dimensions. These embodiments create a more uniformed appearance for the cellular panel 106 (especially for taller cellular panels 106), as all the cells 108 may appear to have substantially the same dimensions, although they may be formed in substantially the same manner as the cellular panel 106 illustrated in FIG. 14.

One aspect of the cell structure disclosed herein is the constancy of appearance during retraction and extension of the shade panel from the support tube. In many instances, cellular shades are retracted by stacking from the bottom-up, which changes the appearance of the cells at the bottom of the shade panel as they are compressed and collected by the lifting of the bottom rail. The same distortion of the cells occurs during extension of the stacked cells. In at least one example of the cellular shade as described and disclosed herein, the appearance of the cells (individually and collectively) during retraction and extension are not substantially affected, and in some instances are not affected at all.

Figure 27:
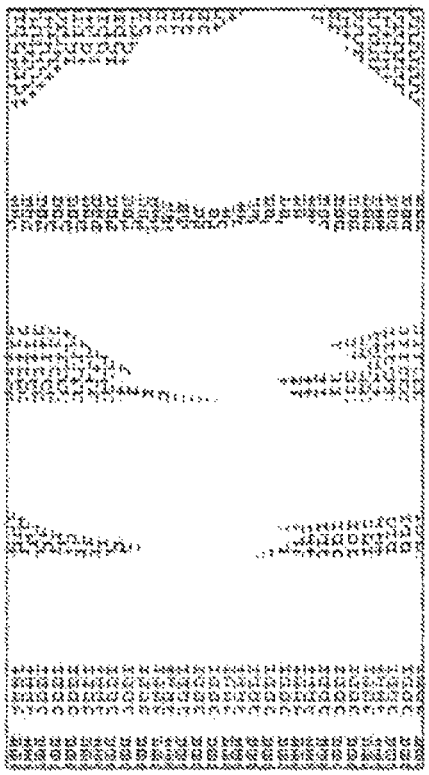
FIG. 27 is a front elevation view of the cell of FIG. 26.
Figure 32:
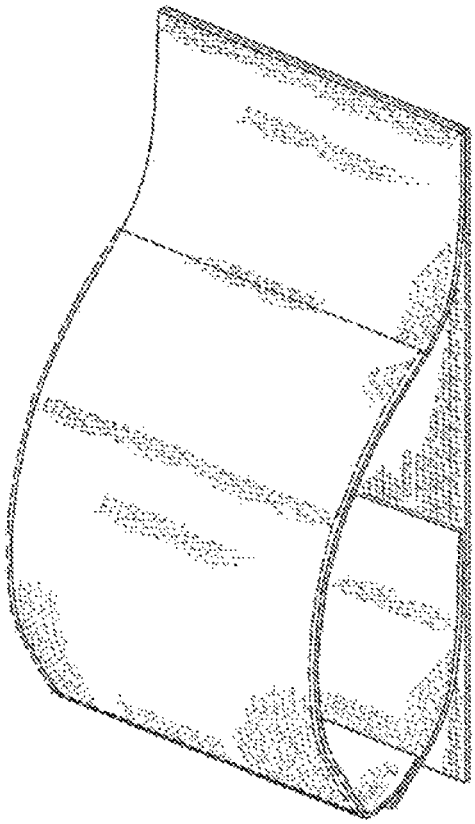
FIG. 32 is an enlarged perspective view of the cell of FIG. 25 with a cell support member in dashed lines on a front side of a vane material for the cell.
Figure 33:
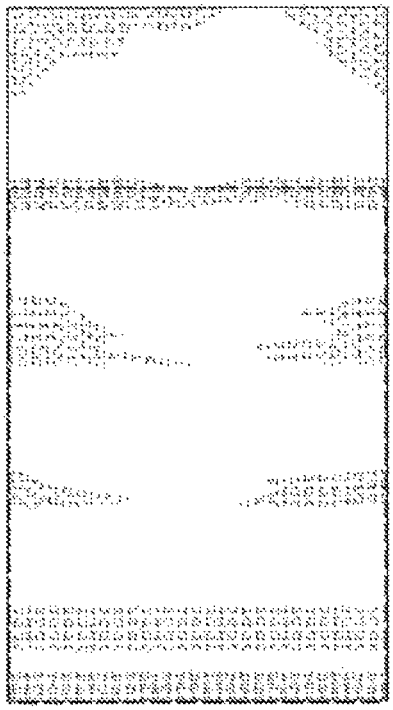
FIG. 33 is a front elevation view of the cell of FIG. 32.

The shade panel, for instance 106 in FIG. 1, and also partially shown in FIGS. 7 and 27, for instance, includes a panel cells extending laterally and positioned above one another vertically. Each cell has a height and amount of curvature of the vane defined by at least in part by the curvature created by the cellular support material, as well as by the attachment locations of the vane material to the support sheet and the immediately adjacent lower vane to which the vane material is operably attached. This height and curvature creates a first appearance for the individual cells. Note that the individual cells may each have a different first appearance, or may have a similar or identical first appearance. The plurality of cells forming the shade panel also create an overall, or collective appearance, which may be created by two adjacent or non-adjacent cells, or more than two adjacent cells. The appearance of this collection of cells creates a second appearance.

Unlike the changing appearance of stacked cellular shade panels when retracted and extended, the appearance of at least one example of the cells disclosed and described herein does not substantially change upon extension or retraction. In other words, the appearance of individual cells or a collection of the cells, is not greatly affected by the amount the shade is extended, or the act of extending or retracting the cells. This constancy of appearance, both individually and collectively, is due to the use of the support tube to retract and extend the cells. Since the support tube is engaged with or operably associated with the top portion of the shade panel (such as by attaching to the support sheet), the appearance of individual cells and/or collection of cells are not changed substantially between the bottom of (or below) the support tube and the bottom rail positioned at the lower edge of the shade panel. Until actual engagement around the support tube (during retraction) the appearance of a particular cell is largely unchanged from it's appearance when the shade is fully extended. The collective appearance of the cells between the head tube and the bottom rail (other than the shade panel becoming shorter in length) is also largely unchanged. Similarly, upon extension from a retracted position, once a cell has been unwound from the support tube, its individual appearance is largely unchanged during extension below the head tube.

Unlike stackable cellular shades, in at least one example of the cellular shade structure described and disclosed herein, the appearance of the individual cell or a collection of cells below or not engaging the support tube is largely unchanged during retraction and extension. The height, curvature or lateral depth (from front of the vane material to the support sheet, as created by chamber size) that together or individually create or affect the appearance of the individual or collection of cells are substantially unchanged. The effect is that the shade panel has a clean and consistent appearance not affected by the vertical position (amount of retraction or extension) of the shade panel.

Figure 16:
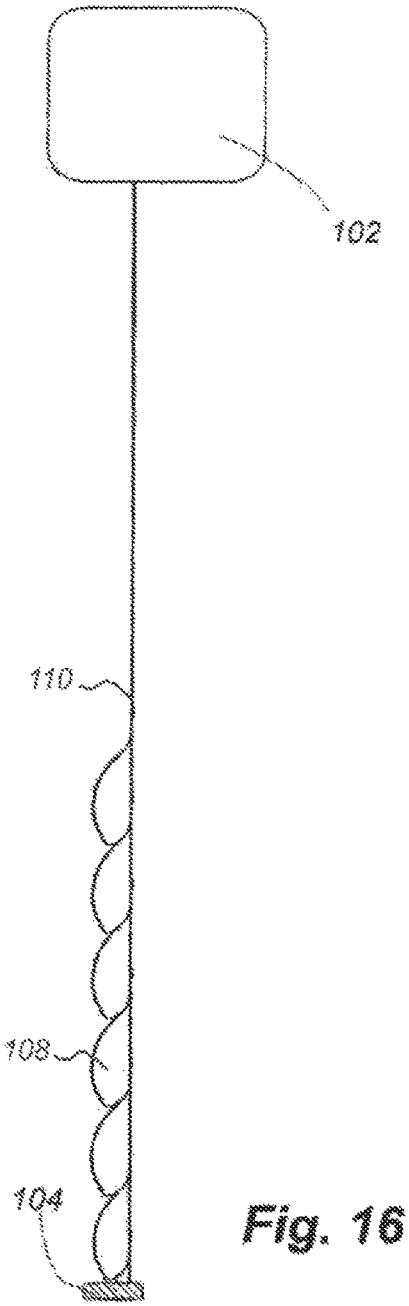
FIG. 16 is a side elevation view of a sixth embodiment of the panel of FIG. 1.
Figure 17:
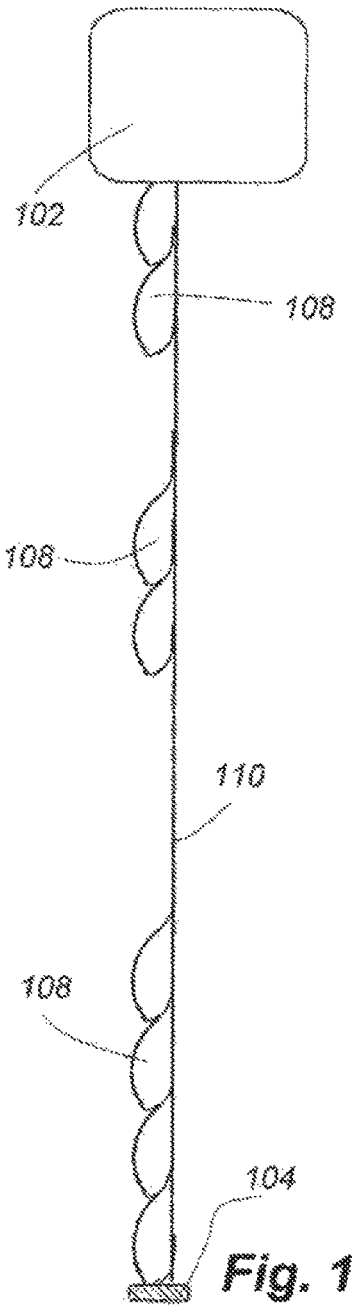
FIG. 17 is a side elevation view of a seventh embodiment of the panel of FIG. 1.

FIGS. 16 and 17 illustrate side elevation views of additional embodiments for the cellular panel 106. In these embodiments, the cells 108 may be spaced intermittently along the support sheet 110 with spaces of no cells or different shade elements positioned between the groupings of cells 108. For example, referring to FIG. 16, there may be no cells 108 positioned near the top of the cellular panel 106 near the support tube 116, but only at the bottom of the cellular panel 106 or shade structure. Additionally, as shown in FIG. 17, there may be a cluster or group of cells 108 near a middle section of the cellular panel 106, as well as near a bottom of the cellular panel 106 near the end rail 104. Between the groups of cells 108 the support sheet 110 may be exposed, or another layer of material may be operably connected to the panel between each cell 108 group. In these embodiments, the cellular panel 106 may be customized depending on the tastes and desires of the user.

Additionally, the embodiments of FIGS. 16 and 17 allow the cells 108 to be grouped together to best provide blocking of sunlight (if for example, the architectural opening is a window), while still providing a refined overall appearance. It should be noted that alternative variations of cell 108 groupings are possible, and FIGS. 16 and 17 are simply examples of potential cell 108 groupings. For example, there may be panels having only a few cells 108, whereas other panels may be substantially or completely covered in cells 108. Additionally, the groupings or clusters of cells 108 may include as few or as many cells 108 as desired by the user. In some examples the cellular support member 114 may be positioned at various locations along the length of the vane material 112. For example, the cellular support member 114 may run approximately the entire height of the vane material 112 or only a portion of the length. The cellular support member 114 may be positioned along any portion of the vane material 112 as well, for example, in the middle, at the top, or at the bottom.

Figures 24A, 24B:
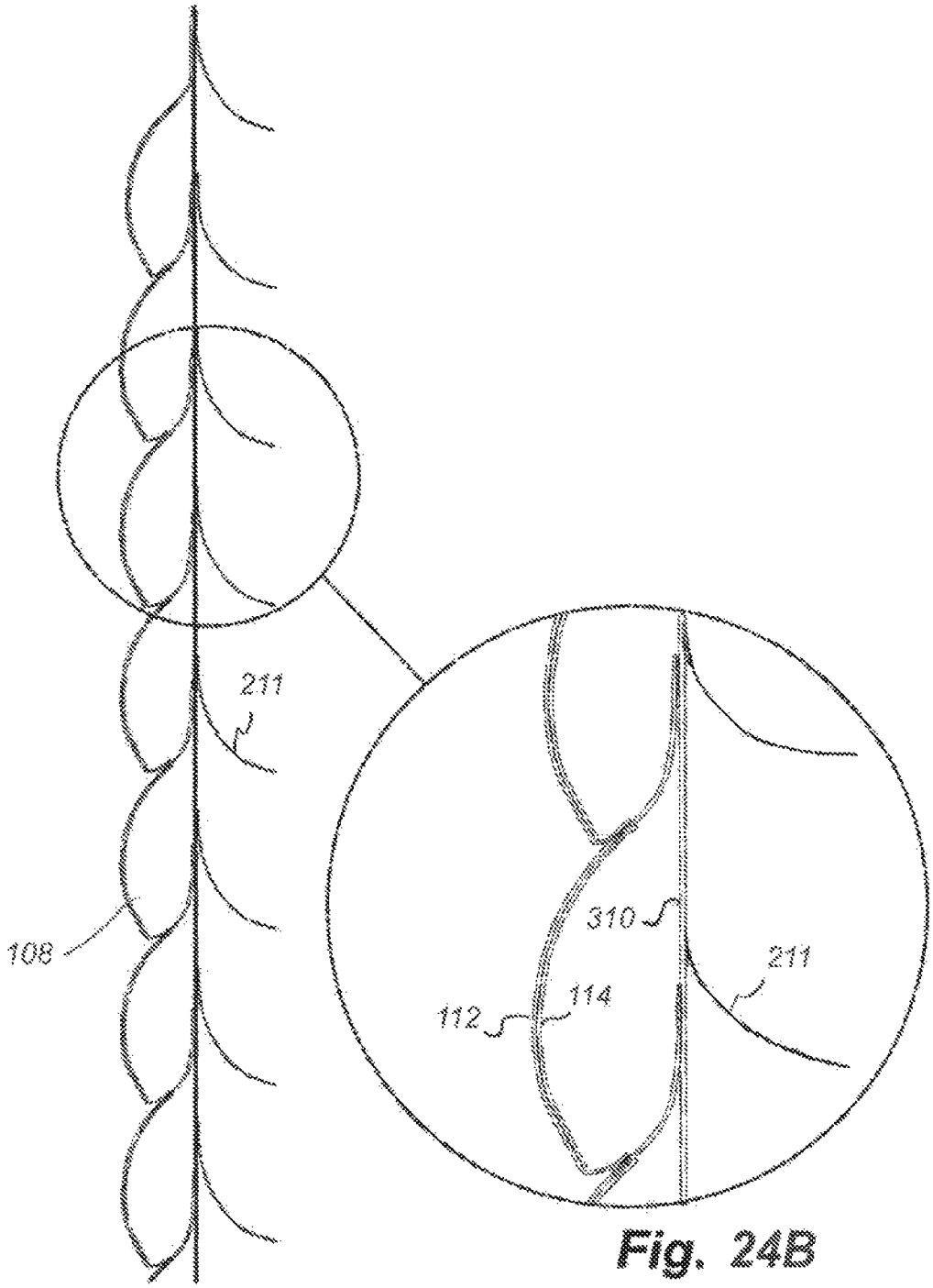
FIG. 24A is a side elevation view of a tenth embodiment of a panel for coving an architectural opening.
FIG. 24B is an enlarged elevation view of the embodiment of the panel of FIG. 24A.

In other embodiments, the cellular panel 102 may include cells 108 on one side and one or more vanes 211 or slats extending from an opposite side. FIGS. 24A and 24B show a cellular shade cells of FIG. 7*a* formed on one side. In this instance, vanes 211 extend off of the opposite side of the panel from the cells 108. The vanes 211 may be formed from a relatively flexible material, such as fabric, or may be formed similarly to the cells 108. That is, the vanes 211 may have an outer or vane material and a support member that may provide some rigidity to the vane material.

Figure 21:
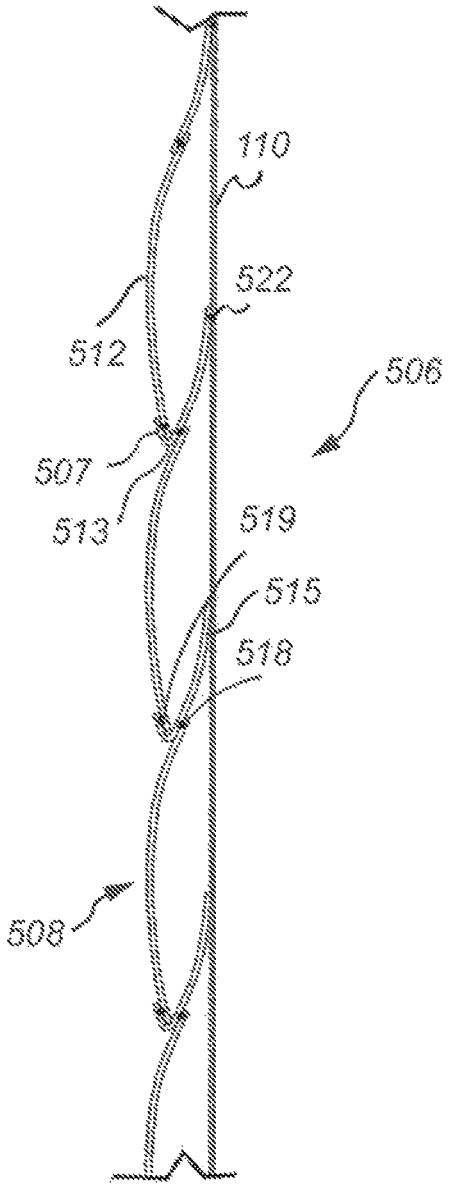
FIG. 21 is an elevation view of a ninth embodiment of a panel for covering an architectural opening.

In other examples, the panel may include cells that may be defined by a vane material, the support sheet, and one or more connecting members. FIG. 21 illustrates another example of a panel 506 for covering an architectural opening. The panel 506 may include cells 508 which may be defined by a vane material 512 impregnated with the cellular support member 114 that may be operably connected to the support sheet 110 and vertically adjacent cells 508 by a connection member 515. In this embodiment, an effective length (as measured along the vertical length of the panel from the head rail to the floor) of the vane material 512 with respect to the support sheet 110 may be extended, because the connection member 515 extends an appearance of the length of each vane material 512 member. The connection member 515 may also extend the vane material 512 away from the support sheet 110, so that the panel 506 may have a larger overall width (as measured between the backing sheet and the cells) than other embodiments. The connection member 515 may be operably connected to the support sheet 110 via an adhesive 522 or other attachment means, and to the vane material 512 by an adhesive 519 or other attachment means. The connection member 515 may be similar to the vane material 512 but may not include the cellular support member so that it may be a generally flexible material that is configured to be wound around the support tube 116.

The connection member 515 may include a tab 507 formed by folding the connection member 515 at fold line 513. The tab 507 may extend upwards and away from the panel. The fold line 513, the tab 507 and the connection member 515 defined a generally "V" shaped recess that receives a terminal end of the vane material 512. An adhesive 519 positioned in or near the V-shaped recess may then connect an outer surface of each vane material 512 and an inner surface of the tab 107. In other words, the V-shaped portion may cradle a terminal end of each vane material 512, and an adhesive strip 519 may generally secure the slat vane material 512 in place. The tab 107 may be visible on an outer surface of the panel 506.

Additionally, the top edge of the vane material 512 may be operably connected by an adhesive 521 to a back surface of the connection member 515, adjacent the bottom edge of the connection member 515. In this example, the vane material 512 may be operably connected to two separate connection members 515, which creates or defines a chamber between the support sheet 110, the two connection members 515, and the slat 511. Thus, the connection members 515, vane material 512, and the support sheet 110 defines the cells 508. The second adhesive 521 may correspond generally to a location (on the opposite face of the connection member 515) where the vane material 512 for the adjacent cell 508 may be received.

Figure 22:
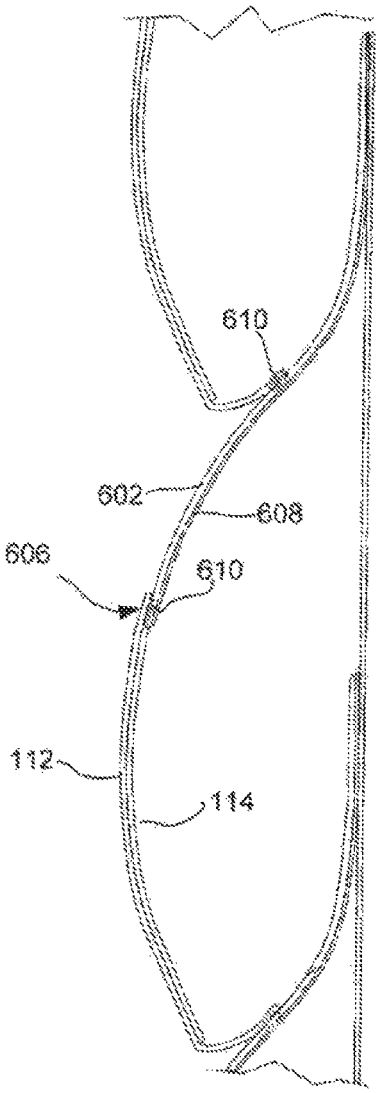
FIG. 22 is a side elevation view of an embodiment of a cell of FIG. 7A.
Figure 23:
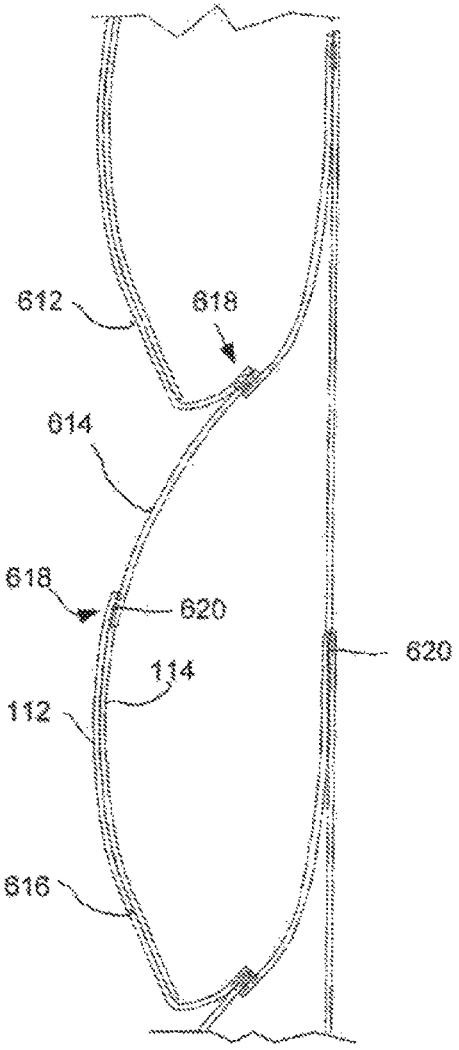
FIG. 23 is a side elevation view of another embodiment of the cell of FIG. 7A.

FIGS. 22 and 23 show the front side of each cell 108 of FIG. 7A, for example, being made of two (FIG. 22) or three (FIG. 23) separate pieces connected together such as by adhesive, sewing, or other attachment means. FIG. 22 shows a front side made of two-pieces. The top piece 602 and the bottom piece 604 are attached by an overlapping region 606 having adhesive 610 positioned there between. The cell support structure 114 is positioned as described above. The top of the front side of the vane is attached to the backing sheet 110 with an adhesive, as described above. The bottom tab 107 of the front side of the vane is attached as described above. A black-out material 608 may be attached to the back or front surface of the top portion of the front side of the vane. This strip-construction provides flexibility with the placement of black-out material, and also allows the two portions of the front side of the vane to be made of different material with different material properties (stiffness, opacity, luminosity, weave, etc.) if desired.

FIG. 23 shows the front side of the cell 108 being formed of three pieces, a top 612 portion, middle portion 614, and bottom portion 616. Each portion 612, 614, 616 is attached to the adjacent portion, such as by an overlapping section having adhesive 620 positioned there between. The cell support structure 114 is positioned as described above relative to the other examples. A black-out material may be attached to the top portion 612, middle portion 614, or both as desired. As with the embodiment shown in FIG. 8, the various portions of the front side of the cell 108 may be designed to have different material characteristics if desired.

Figure 18:
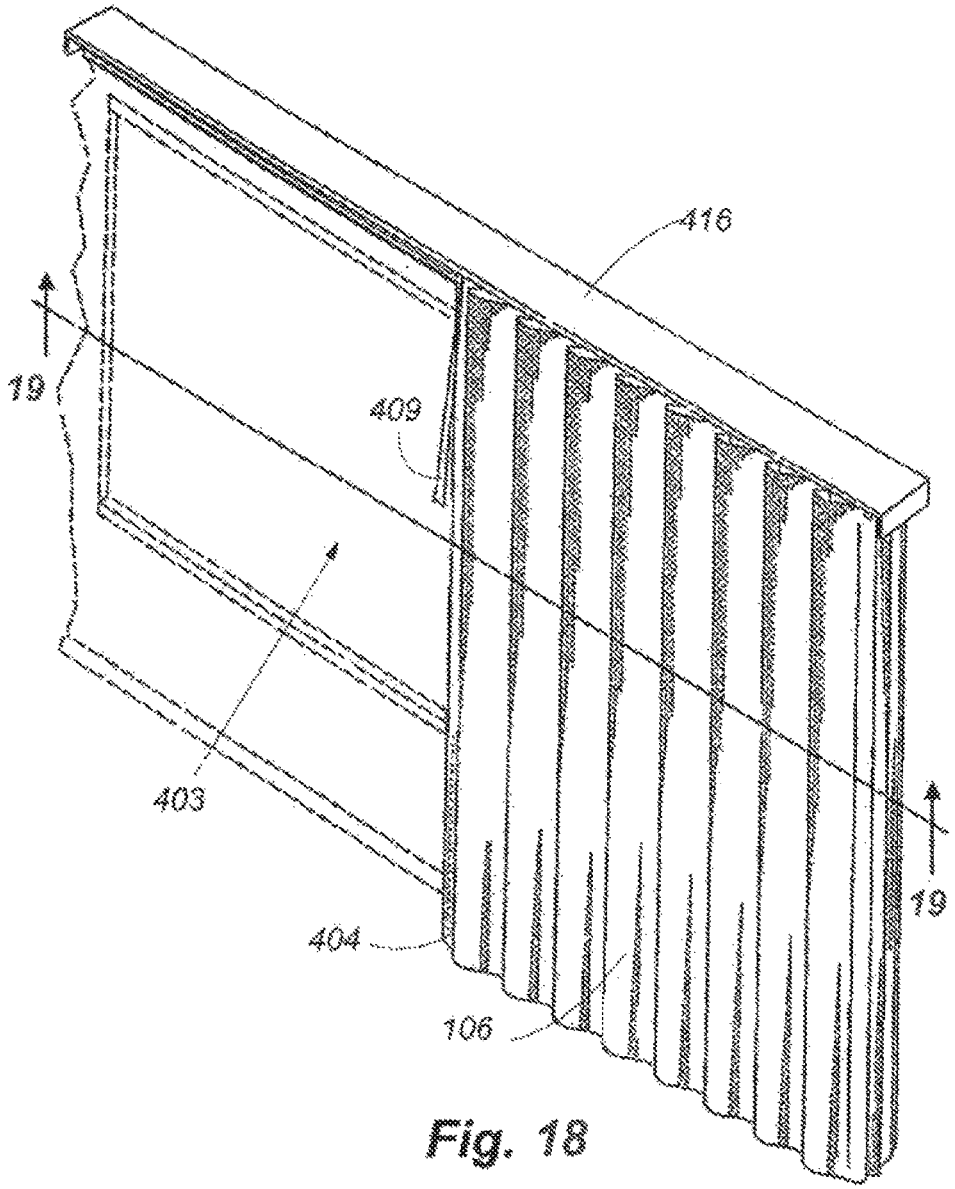
FIG. 18 is an isometric view of a eighth embodiment of a panel for covering an architectural opening that retracts and extends horizontally.

In some embodiments, the cellular panel 106 or panel 306 may be configured to have the cells 108 extend vertically and either be retracted and extended horizontally. FIG. 18 is an isometric view of an example of a panel for covering an architectural opening that retracts and extends horizontally. For example, a head rail 416 may be positioned vertically with respect to an architectural opening 403 and the cellular panel 106 may extend horizontally, across the architectural opening. This embodiment may be different than the embodiment illustrated in FIG. 1, in which the cellular panel 106 may extend and retract vertically with respect to an architectural opening.

Figure 19:
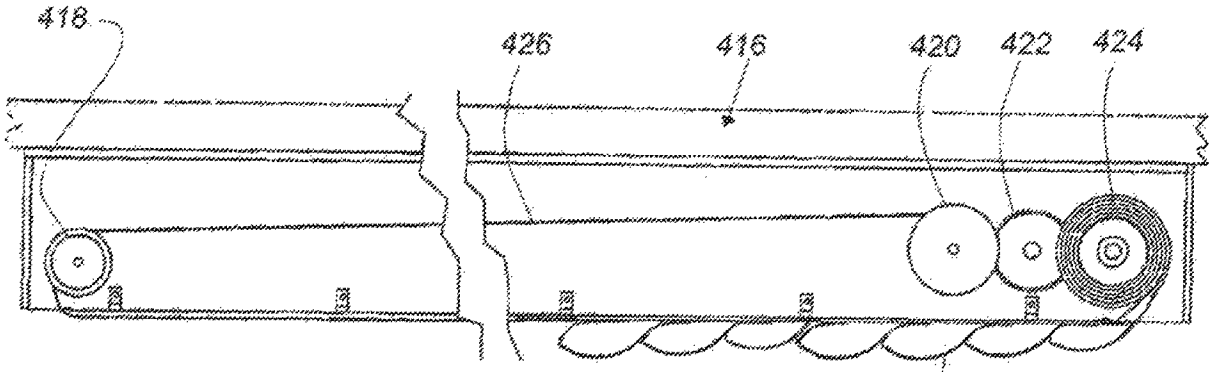
FIG. 19 is a cross-section view of the panel of FIG. 18 in a partially retracted configuration viewed along line 19-19 in FIG. 18.
Figure 20:
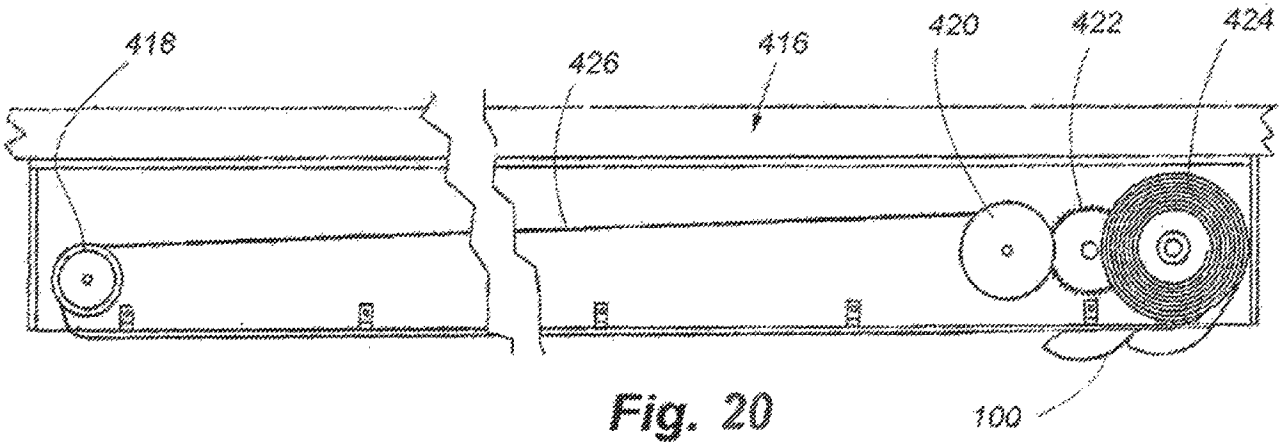
FIG. 20 is a cross-section view of the panel of FIG. 18 in a mostly retracted configuration viewed along line 19-19 in FIG. 18.

FIG. 19 is a cross-section view of the panel of FIG. 18 in a partially retracted configuration viewed along line 19-19 in FIG. 18, and FIG. 20 is a cross-section view of the panel of FIG. 18 in a mostly retracted configuration viewed along line 19-19 in FIG. 18. In embodiments where the cellular panel 106 may extend and retract horizontally the head rail 416 may include a roller 424 (or support tube) on which the cellular panel 106 may wrap itself. The cellular panel 106 may wrap around the roller 424 in substantially the same manner as the cellular panel 106 wraps around the support tube 116 illustrated in FIG. 1. The roller 424 may include a horizontal gear (not shown) that may engage with an idler gear 422. The idler gear 422 may be operably engaged with a take up drum 420 which may be operably associated with a cord 426. The take up drum 420, roller 424, idler gear 422 may all be rotatable about a vertical axis. Thus, as the head rail 416 is suspended from a top of an architectural opening, the roller 424 may extend downwards and perpendicular to the head rail 416. And, as the cellular panel 106 retracts horizontally, it may wrap around the roller 424.

An opposite end of the head rail 416 may include an idler pulley 418 mounted for rotation about a vertical axis. The strap 426 or cord may be operably connected to a control wand 409 and may be operably associated with the idler pulley 418 and the take up drum 420. As the control wand 409 (e.g., end rail 104) moves, the strap 426 may also move and rotate the idler pulley 418 and the take up drum 420. The take up drum 420 then may rotate the idler gear 422, which rotates the roller 424 (via a horizontal gear). The take up drum 420 and the roller 424 may rotate at the same speed, but in opposite directions, as they may be operably connected via the idler gear 422. As the roller 424 rotates, the cellular panel 106 may wrap around itself on the roller 424, thus retracting. Similarly, when the control wand 409 is moved in the opposite direction, the idler pulley 418 and the take up drum 420 rotate in an opposite direction. This rotation causes the idler gear 422 to rotate in an opposite direction, unwinding the cellular panel 106 from the roller 424 and thus extending the cellular panel 106 horizontally over the architectural opening. Thus, movement of the control wand 409 from one end of the head rail 416 to the other causes the cellular panel 106 to be wrapped or unwrapped from the roller 424 as the strap 426 is unwrapped or wrapped around the take up drum 420, respectively.

Figure 25:
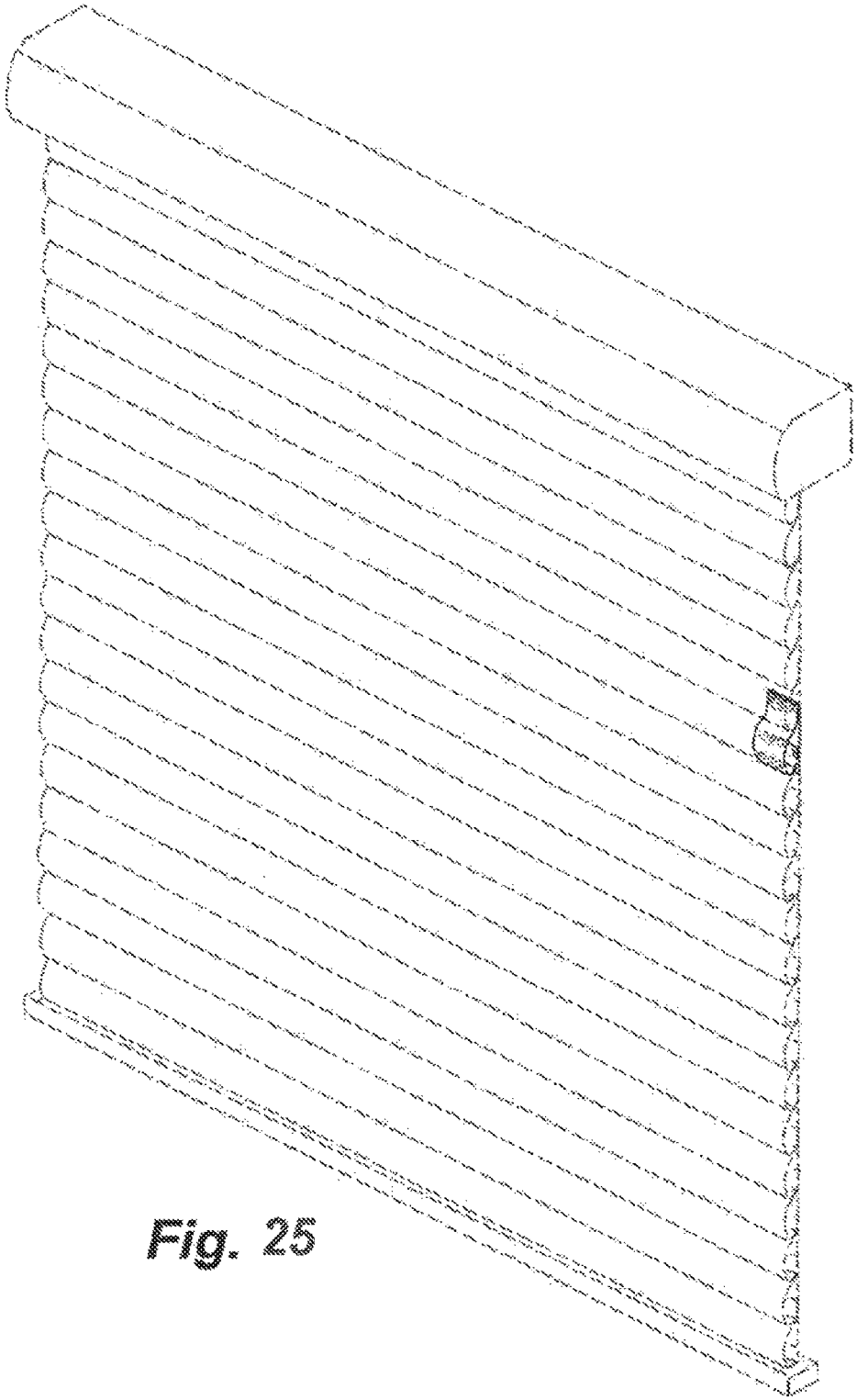
FIG. 25 is a perspective view of an embodiment of a cell for a shade.
Figure 26:
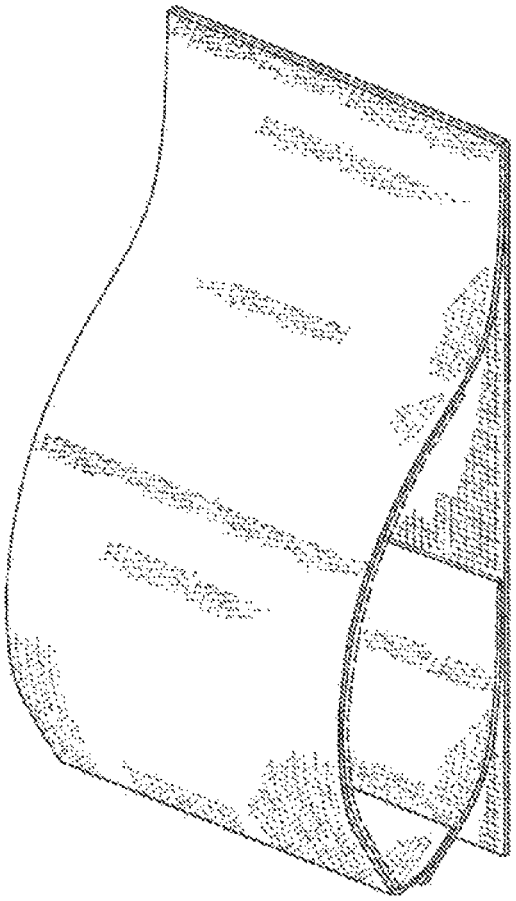
FIG. 26 is an enlarged perspective view of the cell of FIG. 25 with a cell support member in dashed lines on a back side of a vane material for the cell.

FIGS. 25-38 illustrate various views of a cell for a shade. FIG. 25 is a perspective view of the cell illustrating the shade or cellular panel in dashed lines. FIGS. 26-31 illustrate various views of a first example of the cell, where the cell includes a cell support member (indicated in dashed lines) formed or connected to an inner surface of the a vane material. FIGS. 32-38 illustrate various view of a second example of the cell. In these figures, the cell support member (indicated in dashed lines) is formed or connected to an outer surface of the vane material (i.e., the side of the cell that would face towards the room).

It is contemplated that the shade may be retracted or extended by either control cords or by a motor drive system. Using control cords, the control cord(s) would allow manual retraction or extension by a user to the desired position. The control cord(s) engage and actuate a drive mechanism operably associated with the support tube, and positioned in or adjacent the head rail. The drive mechanism may include a clutch (coil spring or otherwise) and transmission (such as a planetary gear mechanism) to improve the gear ratio and allow retraction and extension with less load on the control cord.

Using a motor drive system 209 to retract and extend the shade from the support tube is represented in FIG. 14, by way of one example. In the motor drive system 209, a motor 211 turns the support tube to retract the shade panel by winding it around the support tube during retraction, and turns the support tube to unwind the shade panel from the support tube during extension. The motor drive system 209 may include a drive mechanism, such as an electric motor (which may or may not be reversible), which is operably associated with the support tube. The motor may be integrated into the support tube, or may be separate from the support tube (in axial alignment or not). In FIG. 14, the motor is shown engaged with an axle 213 mounted in the support tube by a belt drive 215, but it is contemplated that a gear drive mechanism, planetary gear mechanism, or the like may also be utilized. The motor is supplied with electric power from a battery source, line voltage, or otherwise, and its operation to retract or extend the shade panel is controlled by the user through a manual switch (wired or wireless), or automated through a motor controller 217. The motor controller 217 may be in communication with and controlled by a programmable logic controller 219, which may include a processor to allow for direct control from a user, as well as software-based control instructions responsive to real-time control signal(s) from associated sensor(s), or pre-programmed signals from a control program. Additionally, the controller may be in communication with the internet or dedicated local communication system to allow for remote control by a user, either manually or automatically. The control signals provided to the motor manually or through the motor controller may be wired or wireless (e.g. RF, IR, or otherwise as is known). As shown in FIG. 14, the motor controller 217 is in wired communication with the motor, and the logic controller 219 is in wired communication with the logic controller, each being discrete elements of the system. It is contemplated that the motor controller and the logic controller may be integrated into the motor (a "smart" motor), which would allow for fewer components and smaller overall system. The motor-controlled retraction of the shade panel would thus control the retraction and extension of the cellular shade panel as defined herein by being wound and unwound around a support tube, as indicated by the arrow in FIG. 14. This action may be implemented without the use of any manual control cords and the associated maintenance, potential breakage, and other issues associated with use of control cords.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

What is claimed:

1. A covering for an architectural opening, said covering comprising:

a plurality of cells each formed from a vane material, said vane material of at least one of said cells including a top edge, a bottom edge, and a crease located between said top and bottom edges of said vane material and extending along a length of said vane material; and a cell support member associated with said vane material of said at least one of said cells, said cell support member including a top edge and a bottom edge;

wherein:

said bottom edge of said cell support member is positioned adjacent to a top portion of said crease; and said cell support member extending from said top portion of said crease towards said top edge of said cell to provide a biasing force that expands said at least one of said cells.

2. The covering of claim 1, wherein said bottom edge of said cell support member is aligned with said crease.

3. The covering of claim 1, wherein said cell support member is impregnated into said vane material of said at least one of said cells.

4. The covering of claim 1, wherein said cell support member extends along an inner surface of said vane material of said at least one of said cells.

5. The covering of claim 1, wherein said cell support member extends along an outer surface of said vane material of said at least one of said cells.

6. The covering of claim 1, wherein said cell support member comprises a thermoformable material.

7. The covering of claim 1, wherein said vane material of said at least one of said cells further comprises a main body and a tab separated from said main body by said crease.

8. The covering of claim 7, wherein:

said vane material of said at least one of said cells includes a first portion and a second portion;

said first portion is associated with said main body and faces forwardly away from a support sheet; and said second portion is associated with said tab and extends from said first portion toward said support sheet.

9. The covering of claim 7, wherein said cell support member is associated with said main body of said vane material of said at least one of said cells.

10. The covering of claim 1, further comprising a support tube, wherein:

said covering is coupled to and retractable onto said support tube; and said cell support member has a curvature substantially the same as a portion of the perimeter of said support tube.

11. The covering of claim 10, wherein said cell support member is configured to collapse upon retraction onto said support tube.

12. A covering for an architectural opening, said covering comprising:

a plurality of cells each formed from a vane material, said vane material including a top edge and a crease; and a cell support member associated with said vane material of at least one of said cells and configured to support said vane material in a curved configuration when said covering is in an extended position, said cell support member being resilient so as to allow said at least one of said cells to at least partially collapse when said covering is retracted, said cell support member including a bottom edge and a top edge, said bottom edge of said cell support member positioned adjacent said crease, said cell support member extending towards said top edge of said vane material to spring or bias said at least one of said cells to an open configuration when said covering is extended.

13. The covering of claim 12, wherein said cell support member is impregnated into said vane material.

14. The covering of claim 12, wherein said cell support member extends along an inner surface of said vane material.

15. The covering of claim 12, wherein said cell support member extends along an outer surface of said vane material.

16. The covering of claim 12, wherein said curved configuration comprises a convex shape.

17. The covering of claim 12, wherein said curved configuration comprises a convex shape in a direction facing an associated room.

18. The covering of claim 12, wherein said vane material of said at least one of said cells comprises a convex portion and a concave portion.

19. A covering for an architectural opening, said covering comprising:

a panel comprising:

a first cell comprising:

a first vane material including a top portion, a bottom portion, and a crease positioned between said top and bottom portions; and a first cell support member including a top edge and a bottom edge, said first cell support member extending along a length of said first vane material, said bottom edge of said first cell support member positioned adjacent said crease of said first vane material and extending towards said top portion of said first vane material; and a second cell overlapped by said first cell, said second cell comprising:

a second vane material including a top portion, a bottom portion, and a crease positioned between said top and bottom portions; and a second cell support member including a top edge and a bottom edge, said second cell support member extending along a length of said second vane material, said bottom edge of said second cell support member positioned adjacent said crease of said second vane material and extending towards said top portion of said second vane material;

wherein said first cell support member and said second cell support member are resilient so as to allow said first cell and said second cell to at least partially collapse when said panel is retracted, and to spring or bias said first cell and said second cell to an open configuration when said panel is extended.

20. The covering of claim 19, further comprising a support tube to which said panel is coupled, wherein:

said first cell has a first appearance when said panel is extended;

said second cell has a second appearance when said panel is extended; and upon retraction of said first cell around said support tube, said second appearance of said second cell remains substantially constant.

21. The covering of claim 19, wherein said first vane material is coupled to said second vane material.

22. The covering of claim 21, wherein:

said first vane material comprises a main body and a tab separated from said main body by said crease; and said tab is attached to said second vane material.

* * * * *